US007373750B2

(12) United States Patent
Kohama

(10) Patent No.: US 7,373,750 B2
(45) Date of Patent: May 20, 2008

(54) FRAME WITH STAND

(76) Inventor: Michio Kohama, 374-1, Hiru-Cho, Matsusaka-Shi, Mie-Ken (JP)

( * ) Notice: Subject to any disclaimer, the term of this patent is extended or adjusted under 35 U.S.C. 154(b) by 48 days.

(21) Appl. No.: 11/585,296

(22) Filed: Oct. 19, 2006

(65) Prior Publication Data

US 2007/0289188 A1 Dec. 20, 2007

(30) Foreign Application Priority Data

May 23, 2006 (JP) ..... 2006-142412

(51) Int. Cl.
*A47G 1/06* (2006.01)

(52) U.S. Cl. ..... 40/746; 40/754; 40/757; 248/493

(58) Field of Classification Search ..... 40/746, 40/754, 757
See application file for complete search history.

(56) References Cited

U.S. PATENT DOCUMENTS 1,001,403 A * 8/1911 Hipwell ..... 40/747
4,357,769 A * 11/1982 Leahy ..... 40/747

FOREIGN PATENT DOCUMENTS

| | | |
|---|---|---|
| JP | 64-1564 | 1/1989 |
| JP | 3032714 | 10/1996 |
| JP | 10-33335 | 2/1998 |
| JP | 11-59018 | 3/1999 |
| JP | 3075177 | 11/2000 |
| JP | 2002-219037 | 8/2002 |
| JP | 3119945 | 2/2006 |

* cited by examiner

*Primary Examiner*—Cassandra Davis
(74) *Attorney, Agent, or Firm*—Jordan and Hamburg LLP

(57) ABSTRACT

A convenient frame has a stand the use of which can be selected between use in a state that the frame is hung on a wall and use in a state that the frame is stood on a table surface for displaying pictures, photos, diplomas, certificates and the like. A folding stand is formed by a turning base plate and a ground seat pivotally joined to the turning base plate via an opening and closing hinge positioned on a straight line parallel to one side of a rectangular frame main body so that the ground seat can be freely operated to open and close to stand up and down to the turning base plate, and the stand is shaped into a size the whole of which is hidden behind the frame main body.

5 Claims, 23 Drawing Sheets

FRAME WITH STAND

BACKGROUND OF THE INVENTION

The present invention relates to a convenient frame with a stand the use of which can be selected between use in a state that the frame is hung on a wall face of a building and use in a state that the frame is stood on a table surface for showing various exhibit sheets such as pictures, photos, diplomas, certificates at home.

This type of frame with a stand has already been proposed in Japanese Published Unexamined Patent Application No. 2002-219037, and this is regarded as a known technique most approximate to the present invention.

Namely, in the second embodiment disclosed in FIG. 6 and FIG. 7 of this known invention includes is a tabletop stand (stand) (5), and a pair of strap-hanging hook portions (A1) and (A1) arranged in line along the shorter side of a rectangular photo ornament fixture (frame) and a pair of strap-hanging hook portions (A2) and (A2) arranged in line along the longer side of the same photo ornament fixture, provided on a back side structure (2) of the frame (1).

By tying a strap (R) to the strap-hanging hook portions (A1) and (A1), the photo ornament fixture can be hung on the wall face of a building and used in a state that a shorter side is at the top, and by tying the strap (R) to the other strap-hanging hook potions (A2) and (A2), the photo ornament fixture can be hung on the wall face of the building and used in a state that a longer side is at the top.

However, the summary described in the claims of the known invention simply aims at an increase in easiness of production and relates to "a photo ornament fixture including a frame (1) whose back side (1*a*) is formed into a flat plane, and a back side structure (2) to be fixed to the back side (1*a*) of the frame (1), wherein the back side structure (2) includes a glass plate (3), a plastic-made holder plate member (4), and a tabletop leg (5), and on the holder plate member (4), a shallow concave portion (6) in which the glass plate (3) is fitted is formed and the tabletop leg (5) is attached, and a slit (7) is provided for inserting a photo (P) between the back side (3*a*) of the glass plate (3) and the bottom face (6*a*) of the concave portion (6) in a state that the glass plate (3) is fitted," and no description is included about an explanation of a construction for turning the tabletop leg (5) according to the usage state that a shorter side or a longer side is at the top of the photo ornament fixture or a method for operating this turning.

With this point of view, even if the reciprocal arrow shown in FIG. 3 suggests turning of the tabletop leg (5), when it means free turning at 360 degrees, in a case where the photo ornament fixture is hung on a wall face of a building in a state that a longer side is at the top as shown in FIG. 6, the tabletop leg (5) is not hidden behind the frame (1) but dangles and is ungracefully exposed from the lower end of the frame (1) due to its own weight.

This is because no fixing member for locking the tabletop leg (5) so as to prevent it from dangling is provided, and this phenomenon also happens when the photo ornament fixture is hung on a wall face of a building in a state that a shorter side is at the top.

In addition, in the construction of the known invention, when hanging the photo ornament fixture on a wall face of a building, it is necessary to specially find a strap (R) for hanging the photo ornament fixture and selectively tie the prepared strap (R) to either the strap-hanging hook portions (A1) and (A1) or the strap-hanging hook portions (A2) and (A2), and therefore this is still very troublesome and inconvenient.

Furthermore, in the back side structure (2) of the known invention, the number of slits (7) for inserting a photo (P) formed between the back side (3*a*) of the glass plate (3) and the bottom face (6*a*) of the concave portion (6) is one and its size is unaltering, so that it cannot be adapted to a change in size of the photo (P), and when a small photo (P) is inserted, an excessive margin appears and the ornamental effect is impaired.

SUMMARY OF THE INVENTION

An object of the present invention is to improve this problem, and for achieving this object, according to a first, main aspect of the invention, shown and described hereinafter in detail, there is provided a frame with a stand including: a frame main body having a rectangular contour which houses various exhibit sheets such as a picture or photo in a space in the front and rear direction between a decorative frame constructionally having a see-through window and a back plate integrally fixed to the back side of the decorative frame in an edging state;

a folding stand formed into a size hidden behind the frame main body by a turning base plate pivotally supported on the back plate of the frame main body via one fulcrum shaft so as to be changeable in orientation by at least approximately 90 degrees to become long lengthwise and sideways, and a ground seat pivotally joined to the turning base plate via an opening and closing hinge positioned on a straight line parallel to one side of the frame main body so that the ground seat can be freely operated to open and close to stand up and down; and four in total of first through four cables attached so as not to come off near the four corners of the back plate of the frame main body in a positional relationship corresponding to intervals to sandwich the stand, wherein each two cables adjacent to each other of the first through fourth cables are selectively tied together between a state that they extend parallel to each other along the shorter side of the frame main body and a state that they extend parallel to each other along the longer side of the frame main body, by the tied two cables on the lower positions, the ground seat of the stand is locked in a closed state that the ground seat is folded down to the turning base plate, and on the other hand, by hanging the other tied two cables on the upper positions on a hook projecting from a wall face of a building, the frame main body can be hung and used in a state that the shorter side or a longer side is at the top, and by releasing the two cables on the lower positions tied so as to lock the ground seat and pulling-up and opening the ground seat from the turning base plate, the frame main body can be stood and used on a table surface in a state that a shorter side or a longer side is at the top.

With the above-described construction of the present invention, the folding stand is formed by the turning base plate and the ground seat pivotally joined to the turning base plate via an opening and closing hinge positioned on a straight line parallel to one side of the rectangular frame main body so that the ground seat can be freely operated to open and close to stand up and down to the turning base plate, and the stand is shaped into a size the whole of which is hidden behind the frame main body.

In addition, this turning base plate of such a stand is pivotally supported on the back plate of the frame main body via one turning fulcrum shaft so as to relatively change its orientation by at least approximately 90 degrees to become long lengthwise and sideways, and on the other hand, near the four corners of the back plate of the frame main body, four in total of the first through fourth cables are attached in advance in a positional relationship particularly corresponding to intervals to narrow the ground seat of the stand.

Therefore, by an operation for changing the tying of each adjacent two of the first through fourth cables attached in advance and an operation for particularly changing the orientation of the turning base plate of the stand by approximately 90 degrees, according to the direction in that various exhibit sheets can be easily seen, the rectangular frame main body can be quickly and easily set not only in a use state that the frame is hung on a wall face of a building but also in a use state that the frame is stood on a table surface while selectively setting its orientation that a shorter side or longer side is set at the top, and this is excellent in convenience in use and versatility for various exhibit sheets.

Namely, while in particular the turning base plate of the folding stand is maintained in the state that a longer side is at the top, each two cables adjacent to each other of the four in total of first through fourth cables are tied together so as to extend parallel to each other along the shorter side of the frame main body, and the tied two cables are set on upper positions and hung on a hook projecting from a wall face of a building, whereby the frame main body can be hung and used in the state that a longer side is at the top.

At this time, by the remaining two cables tied together on the lower positions, the ground seat of the stand can be locked in a closed state that the ground seat is folded down to the turning base plate, and as a result, there is no risk that the ground seat unexpectedly opens from the turning base plate or freely turns around the turning fulcrum shaft of the turning base plate, and the stand can be stably maintained in a fixed state so that it is hidden behind the frame main body.

Then, the state that each two cables adjacent to each other are tied together is released, and the turning base plate of the stand is changed in orientation by approximately 90 degrees around the turning fulcrum shaft, and each two adjacent cables are re-tied so that they extend parallel to each other along the longer side of the frame main body, and two cables tied together are set on the upper positions and hung on the hook projecting from the wall face of the building, whereby the frame main body can be hung and used in the state being long sideways.

Also in this case, by the remaining two cables tied on the lower positions, the ground seat of the stand is locked in the closed state that it is folded down and the stand can be stably maintained in the fixed state that it is hidden behind the frame main body.

Furthermore, in any usage state that a shorter side or a longer side is set at the top, by releasing the two cables tied together on the lower side positions of the frame main body and pulling-up and opening the ground seat of the stand that has become free to open and close to the rear side from the turning base plate, the frame main body can be stably stood and used on a table surface in a state that a shorter side or a longer side is at the top.

At this time, two cables that have been released from the tied state on the lower positions are tied together across the turning base plate of the stand or the back plate of the frame main body so that they are prevented from dangling and being exposed.

By employing a construction according to, a second aspect of the invention and shown and described hereinafter in detail, even if the frame main body has a great difference in length between the longer side and the shorter side, the folding stand can be reasonably shaped into a size that is reliably hidden behind the frame main body, and the adaptability to various rectangular shapes of the frame main bodies is increased.

By employing a construction according to a third aspect of the invention, shown and described hereinafter in detail, various exhibit sheets can be smoothly inserted into and extracted from an exhibit sheet housing space of the frame main body through an exhibit sheet in/out slit opened in one or two longer and shorter sides adjacent to each other of the frame main body, and the exhibit sheets housed in the exhibit sheet housing space can be maintained in a dustproof state by a transparent dustproof cover on the see-through window.

In particular, by employing a construction according to a fourth aspect of the invention, shown and described hereinafter in detail, at least one partition decorative frame interposed inside the frame main body divides the section between the decorative frame and the back plate of the frame main body into at least a pair of front and rear exhibit sheet housing spaces arranged in line, and see-through windows that are similar in shape to the see-through window on the decorative frame on the forefront position and become gradually smaller rearward than the see-through window on the forefront position are opened in the respective partition decorative frames, so that various exhibit sheets with different sizes can be smoothly and selectively housed in the suitable exhibit sheet housing spaces and can be seen through, so that the convenience is further improved and an excellent decoration effect that does not generate an excessive margin can always be obtained.

Furthermore, by employing the construction according to a fifth aspect of the invention, shown and described hereinafter in detail, the frame can be provided with an added value convenient for daily life by utilizing the ground seat of the folding stand. Other effects will become apparent from the detailed description of preferred embodiments of the present invention described later.

DETAILED DESCRIPTION OF THE PREFERRED EMBODIMENTS

Hereinafter, a detailed construction of the present invention will be described with reference to the drawings. First, FIG. 1 through FIG. 5 show a first embodiment of a frame with a stand according to the present invention, and the reference symbol (F) denotes a frame main body made of a light and hard material such as a synthetic resin, light metal, heavy paper, wood shavings, coated plywood board, etc., into a shape with, for example, a rectangular contour having an approximate longer side (y): 340 mm' a shorter side (x): 250 mm, and includes a decorative frame (11) having a rectangular see-through window (10) with an appropriate size opened at the central portion and a back plate (12) integrally fixed to the back of the decorative frame (11) so as to edge the four sides.

As a means for fixing the back plate (12) to the decorative frame (11), an adhesive agent is used in the illustrated embodiment, however, screws or adhesive tape may also be used instead.

The space in the front and rear direction between the decorative frame (11) forming the frame main body (F) and the back plate (12) is demarcated as one exhibit sheet housing space (13) which can house various exhibit sheets (M) such as favorite pictures, photos, a square piece of fancy paper, diplomas, certificates, etc.

Figure 3:
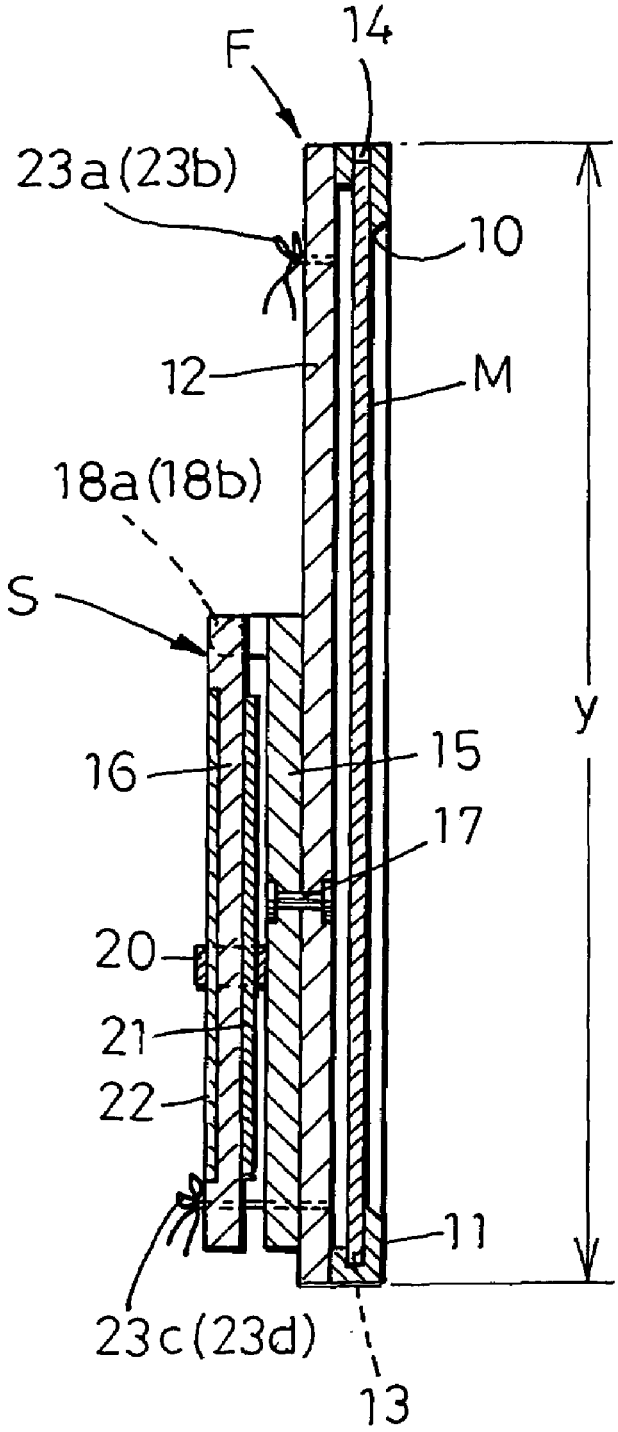
FIG. 3 is a sectional view along the 3-3 line of FIG. 2.

In this case, it is also possible that the one housing space (13) is secured to be wide so as to house a plurality of sheets including spares of the above-described exhibit sheets (M) by thickening the rectangular decorative frame (11) or/and back plate (12) by folding back and overlapping the four sides thereof, forming the four sides into channel-shaped sectional shapes or angled sectional shapes as shown in FIG. 3, or interposing separate spacers (not shown) in the space in the front and rear direction between the decorative frame (11) and the back plate (12) so as to edge these.

In any case, in one side which becomes an upper side position when the frame main body (F) formed by the decorative frame (11) and the back plate (12) is used or in adjacent two sides of a longer side (y) and a shorter side (x), an exhibit sheet in/out slit (14) that communicates with the exhibit sheet housing space (13) is opened, and through this slit, the exhibit sheets (M) can be smoothly put in and taken out from the housing space (13).

The reference symbol (S) denotes a folding stand including a turning base plate (15) and a ground seat (16), and in these members, the turning base plate (15) is pivotally supported on the back plate (12) of the frame main body (F) via a turning fulcrum shaft (17) so as to relatively turn by at least approximately 90 degrees (a) (360 degrees in the illustrated embodiment) to become long lengthwise and sideways, and on the other hand, the ground seat (16) is pivotally joined to the turning base plate (15) via opening and closing hinges (18*a*) and (18*b*) positioned on the straight line (h-h) parallel to one side of the frame main body (F) on the turning base plate (15) so as to freely open from and close to the turning base plate (15).

This folding stand (S) is also made of a light and hard material of the same type as that of the frame main body (F). In this case, as the turning fulcrum shaft (17) for turning the turning base plate (15) with respect to the back plate (12) of the frame main body (F), an appropriate rivet, pin, screw fastening tool, hard paper tube, etc., may be used according to the material forming the frame main body (F).

Figure 4:
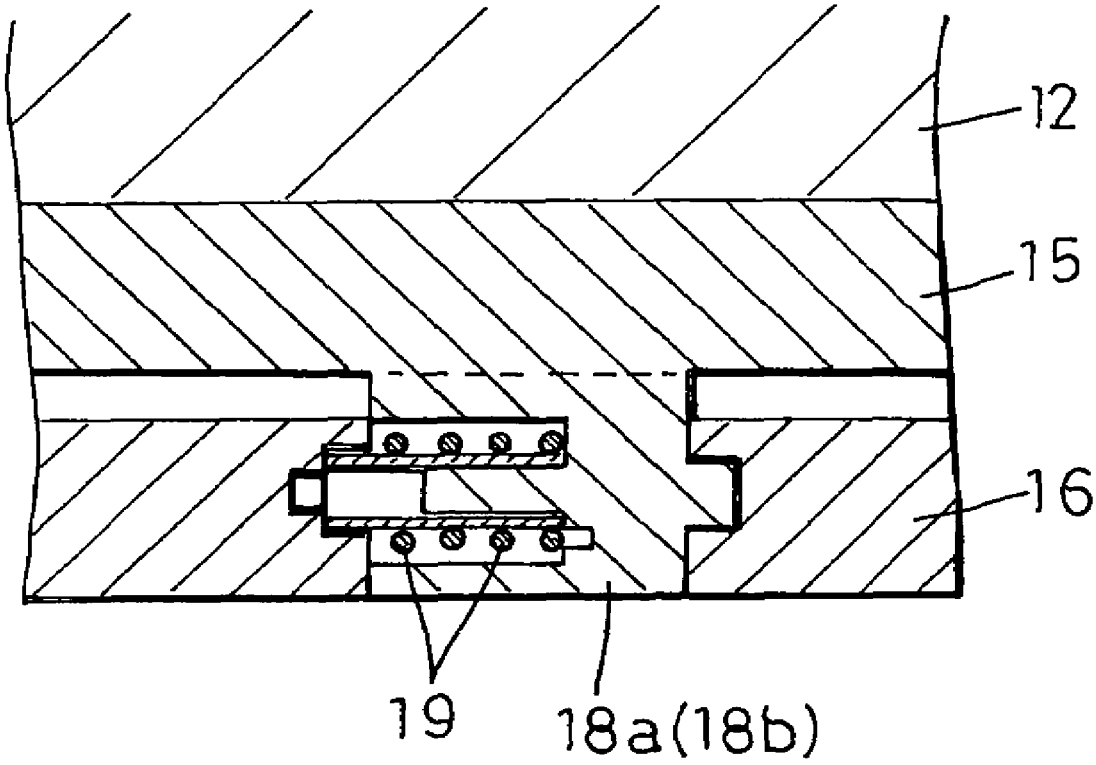
FIG. 4 is an enlarged sectional view showing an example of an opening and closing hinge by extracting it.

As the opening and closing hinges (18*a*) and (18*b*) for joining the ground seat (16) to the turning base plate (15), a hinge which stops at a constant crossover angle (opening angle) (b), a dowel which makes convex-concave fitting, or an adhesive tape, etc., can be used according to the material forming the stand (S), and in particular, it is desirable that a so-called free-stop hinge is used, which can stably stop at a position maintaining an arbitrary crossover angle (b) based on an elastic urging force (braking force) or frictional resistance of a compression coil spring (19) installed inside even when the hand to perform the opening and closing operations is released as illustrated in FIG. 4.

In any case, the stand (S) is formed into a size so that it is hidden behind the frame main body (F) and is not exposed from the four sides of the frame main body (F) even if the stand is changed in orientation by approximately 90 degrees (a) to become long lengthwise and sideways around the turning fulcrum shaft (17) when the ground seat (16) is folded down and closed to the turning base plate (15).

Namely, the distance (L) between the positions (h-h) of the opening and closing hinges (18*a*) and (18*b*) that pivotally join the ground seat (16) to the turning base plate (15) of the stand (S) and the lower side of the ground seat (16) folded down by being turned around the fulcrums of the opening and closing hinges (18*a*) and (18*b*) is set to a length equivalent to or less than the shorter side (x) of the frame main body (F) at a maximum so that the stand (S) cannot be visually observed from the front side of the frame main body (F).

Figure 1:
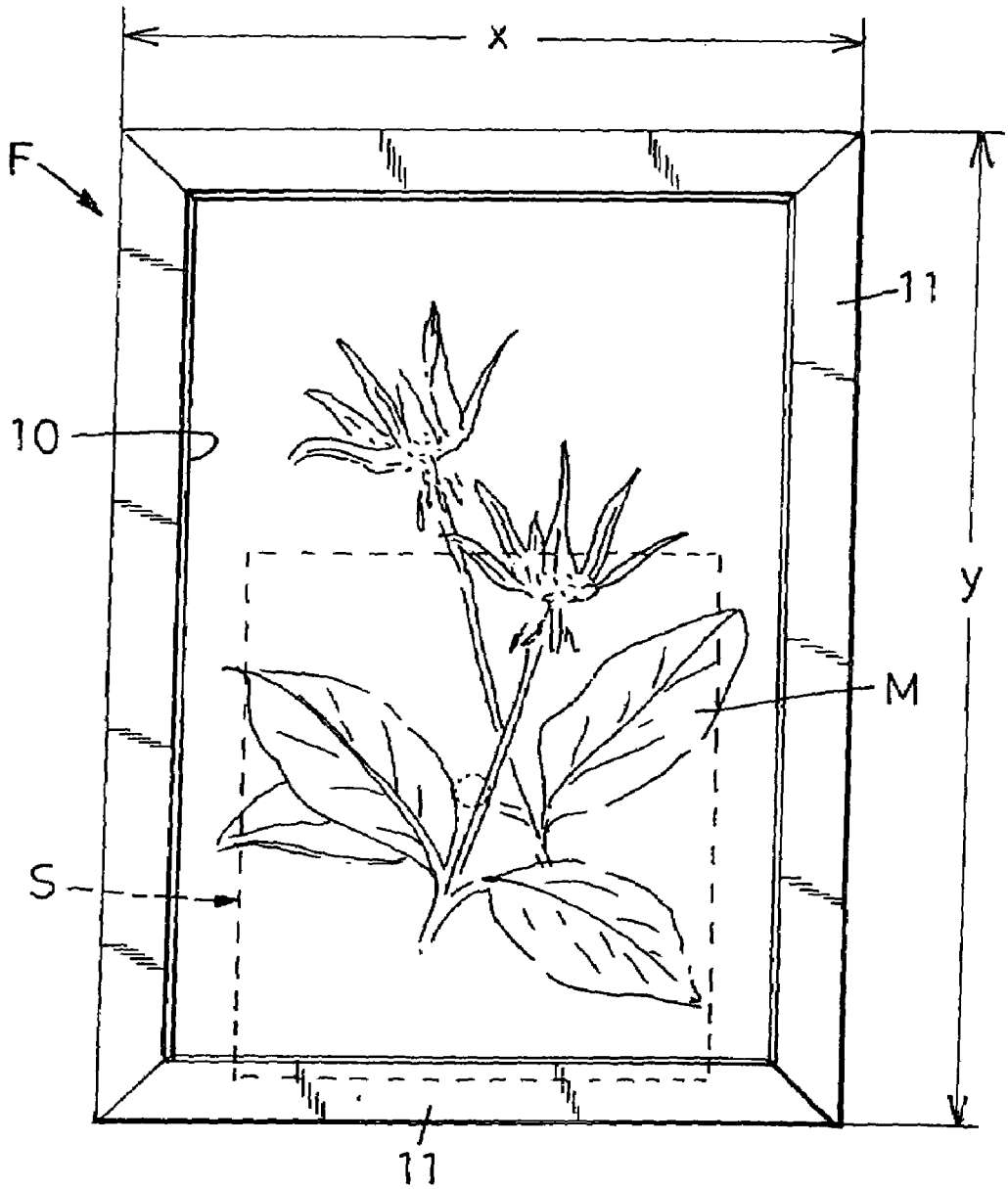
FIG. 1 is a front view showing a first embodiment of a frame with a stand according to the present invention.
Figure 2:
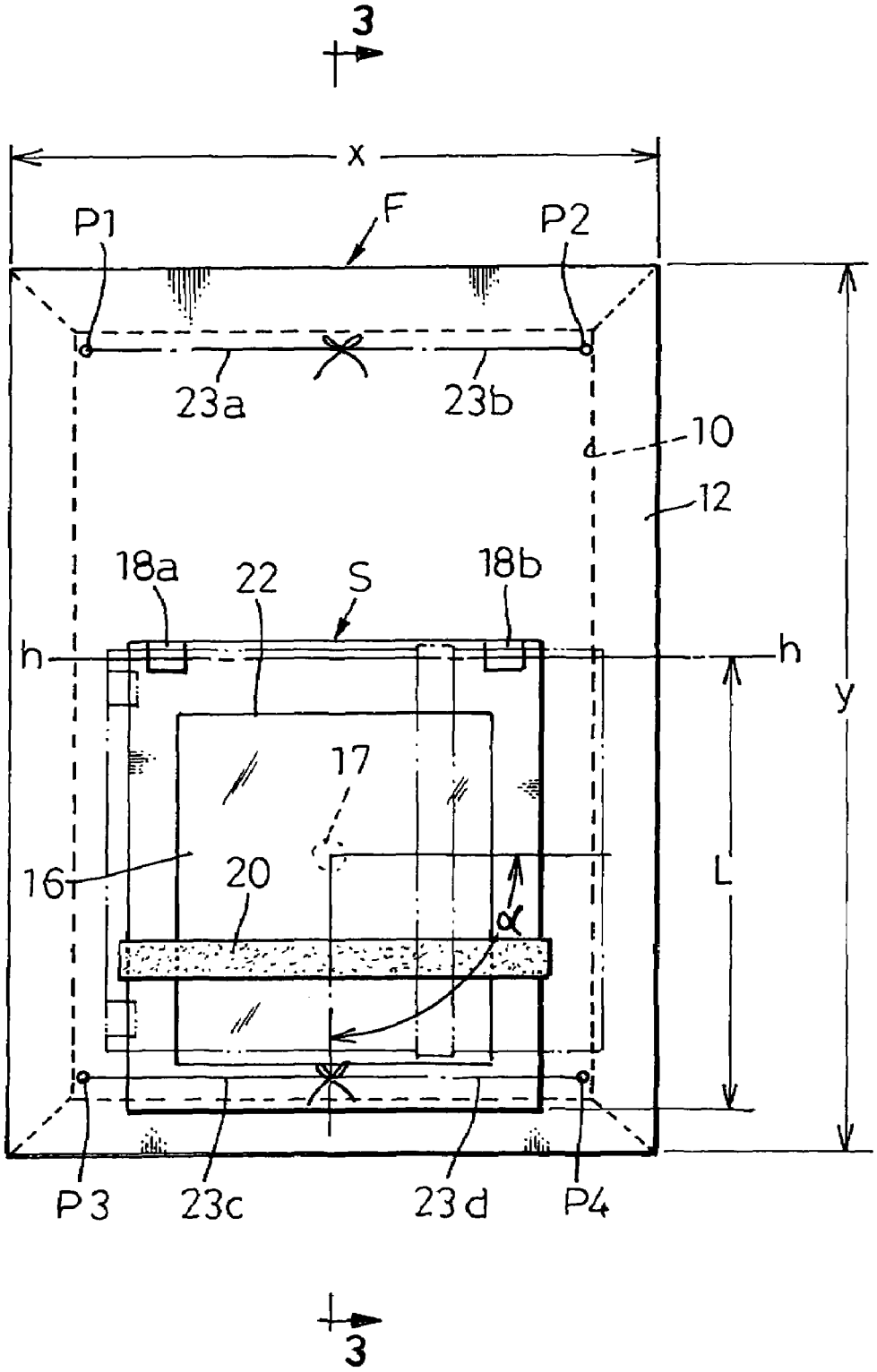
FIG. 2 is a back view of FIG. 1.

In order to satisfy this requirement, in the first embodiment of the present invention in which the difference in length between the longer side (y) and the shorter side (x) of the frame main body (F) is comparatively great, the turning base plate (15) and the ground seat (16) of the stand (S) are formed into rectangular shapes with the same size (for example, approximately 200 mm' 170 mm), and are pivotally joined in a half-folded state via the opening and closing hinges (18*a*) and (18*b*) on the straight line (h-h) as shown in FIG. 2 and FIG. 3, and the central portion of the rectangular turning base plate (15) is pivotally attached to an eccentric position close to the shorter side (x) of the back plate (12) of the frame main body (F) by the turning fulcrum shaft (17).

However, if the lower side of the ground seat (16) which is pulled up and opened around the fulcrums of the opening and closing hinges (18*a*) and (18*b*) from the turning base plate (15) of the stand (S) can be stably seated on the table surface (T) and used in a horizontal state, the size of the turning base plate (15) may be made smaller than the ground seat (16) or the contour of the turning base plate (15) may be made different from that of the ground seat (16).

In this case, the ground seat (16) of the stand (S) is formed into the rectangular shape as shown in FIG. 2, a square, or an isosceles trapezoid and one or two endless stretching bands (20) are wound around the ground seat in a manner enabling these to be unwound and used in a crossover state parallel to the straight line (h-h).

Thereby, various storing sheets (21) whose shapes and sizes are not fixed such as memos of important matters which must be recorded for daily life, newspaper and magazine clippings, etc., can be elastically pressed by the stretching band (20) and stored in the ground seat (16) that is folded and closed to the turning base plate (15), and the storing sheets (21) can thus be prevented from being lost.

It is also possible that a small-sized decorative mirror (22) is integrally buried in the outer surface of the ground seat (16) of the stand (S), and this improves convenience more for daily life and increases the added value of the frame with a stand.

Furthermore, the reference symbols (23*a*), (23*b*), (23*c*), and (23*d*) denote freely bendable cables such as strings or ropes integrally attached in advance near the four corners (P1), (P2), (P3), and (P4) of the back plate (12) forming the frame main body (F) so as not to come off in a positional relationship corresponding to intervals to sandwich, in particular, the ground seat (16) of the folding stand (S), and each two adjacent cables of the four in total are selectively tied to become long sideways or lengthwise.

Figure 5:
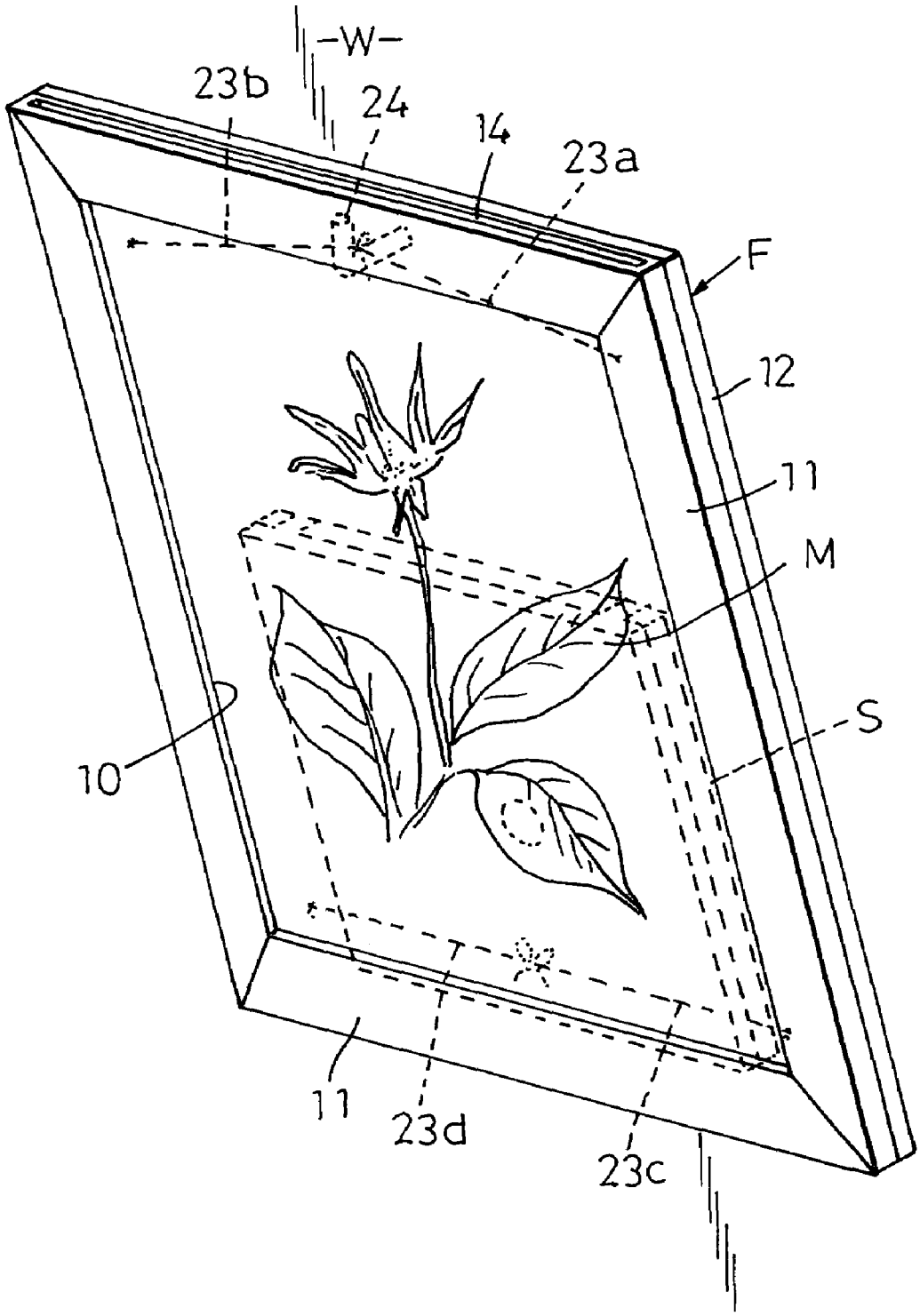
FIG. 5 is a perspective view showing a usage state that the frame is hung on a wall face of a building so that the shorter side is set at the top.
Figure 6:
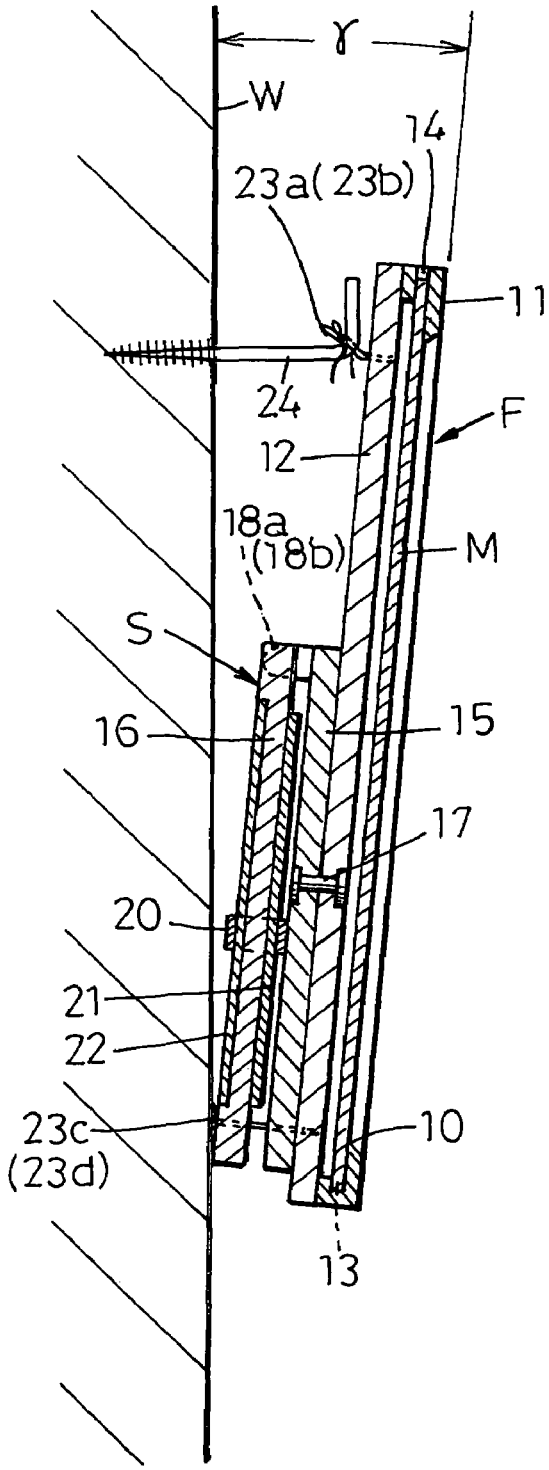
FIG. 6 is a longitudinal sectional view of FIG. 5.

Namely, while the lengthwise state of especially the turning base plate (15) of the stand (S) as shown in FIG. 2 and FIG. 3 is maintained, the two first and second cables (23*a*) and (23*b*) and the two third and fourth cables (23*c*) and (23*d*) of the four in total of the first through fourth cables (23*a*), (23*b*), (23*c*) and (23*d*) are tied together so as to extend parallel to each other along the shorter side (x) of the frame main body (F), respectively, and one tied pair of first and second cables (23*a*) and (23*b*) are set on the upper positions and hung on a hook (24) projecting integrally from a wall face (W) of a building as shown in FIG. 5 and FIG. 6, whereby the frame main body (F) can be hung and used in the state that a shorter side is at the top.

In this case, by the other remaining pair of third and fourth cables (23*c*) and (23*d*) on the lower positions, the ground seat (16) of the stand (S) can be locked in a closed state that the ground seat (16) is folded down to the turning base plate (15) as shown in FIG. 2 and FIG. 3 or FIG. 5 and FIG. 6, and there is no risk that the ground seat (16) unexpectedly opens from the turning base plate (15) or the turning base plate (15) itself freely turns around the turning fulcrum shaft (17).

Figure 10:
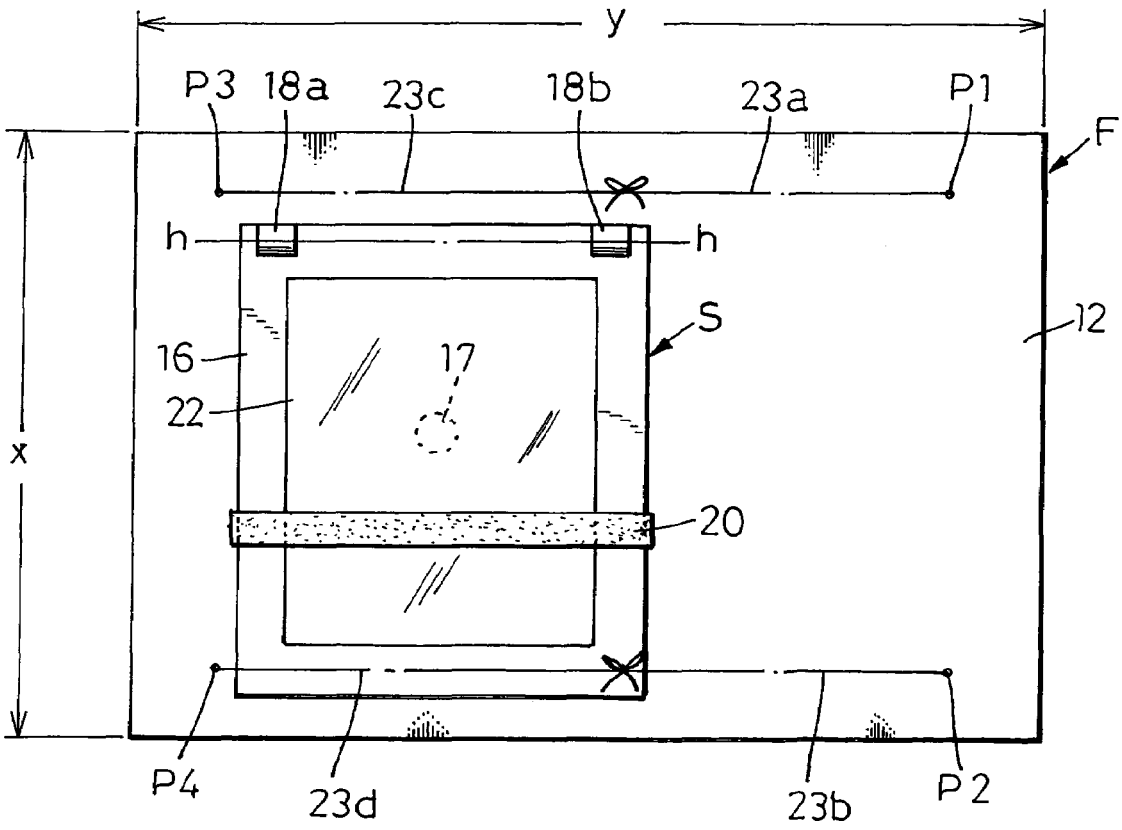
FIG. 10 is a back view of a state that the frame main body and the stand thereof are changed in orientation by approximately 90 degrees, respectively, from the state of FIG. 2.
Figure 11:
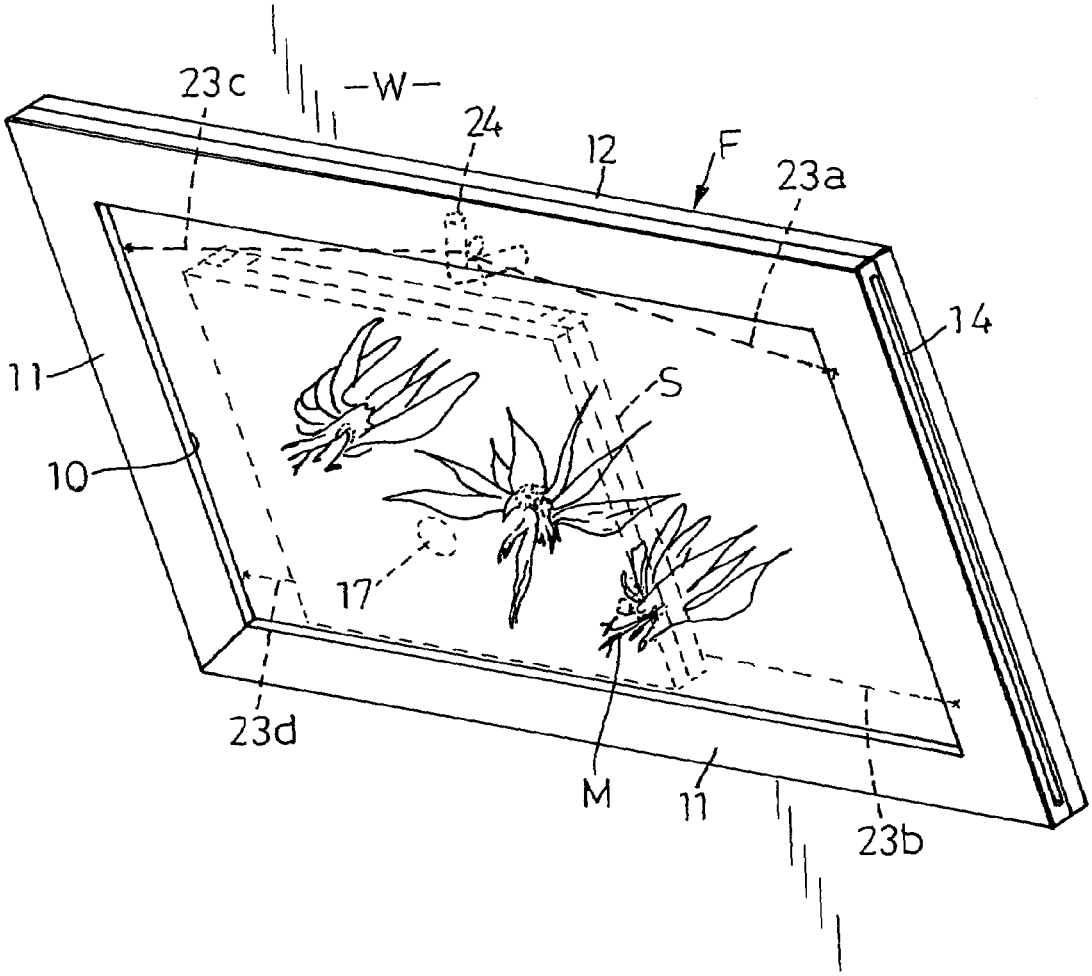
FIG. 11 is a perspective view showing a usage state that the frame is hung on a wall face of a building so that a longer side is set at the top.
Figure 12:
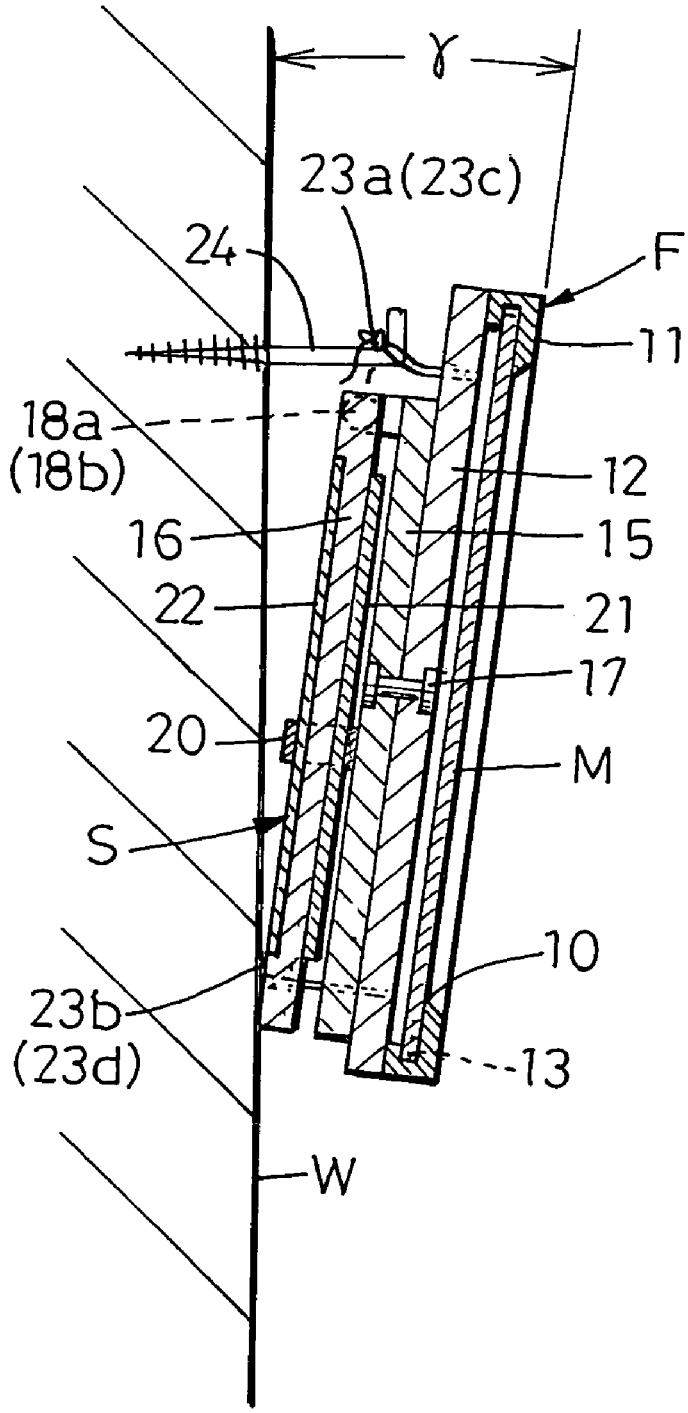
FIG. 12 is a longitudinal sectional view of FIG. 11.

Then, the tied state of the first and second cables (23*a*) and (23*b*) and the tied state of the third and fourth cables (23*c*) and (23*d*) are both released, and as seen in FIG. 10 corresponding to FIG. 2, the turning base plate (15) of the stand (S) is changed in orientation by approximately 90 degrees (a) around the turning fulcrum shaft (17), and the two first and third cables (23*a*) and (23*c*) and the two second and fourth cables (23*b*) and (23*d*) are re-tied so that they extend parallel to each other along the longer side (y) of the frame main body (F), and one tied pair of first and third cables (23*a*) and (23*c*) are set on the upper positions and hung on the hook (24) projecting from the wall face (W) of the building, whereby the frame main body (F) can be hung and used in the state that a longer side is at the top as shown in FIG. 11 and FIG. 12.

Also in this case, by the remaining pair of second and fourth cables (23*b*) and (23*d*) tied on the lower positions, the ground seat (16) of the stand (S) is locked in a closed state that the ground seat (16) is folded down to the turning base plate (15) as shown in FIG. 10 through FIG. 12, and the ground seat (16) can be prevented from unexpectedly opening and the turning base plate (15) itself can be prevented from freely turning.

Namely, the four in total of the first through fourth cables (23*a*), (23*b*), (23*c*), and (23*d*) attached to the back plate (12) of the frame main body (F) are used for performing both the function for hanging the frame main body (F) on the wall face (W) of the building and the function for locking the ground seat (16) of the stand (S) in the folded-down state.

In both the usage state that the frame main body (F) is hung so that a shorter side is at the top and the usage state that the frame main body (F) is hung so that a longer side is at the top, by appropriately adjusting the working lengths of the first and second cables (23*a*) and (23*b*) and the first and third cables (23*a*) and (23*c*) to be hung on the hook (24), the inclination angle (g) of the frame main body (F) with respect to the wall face (W) of the building can be adjusted to be small or large so that the frame can always be directly seen from below.

Figure 7:
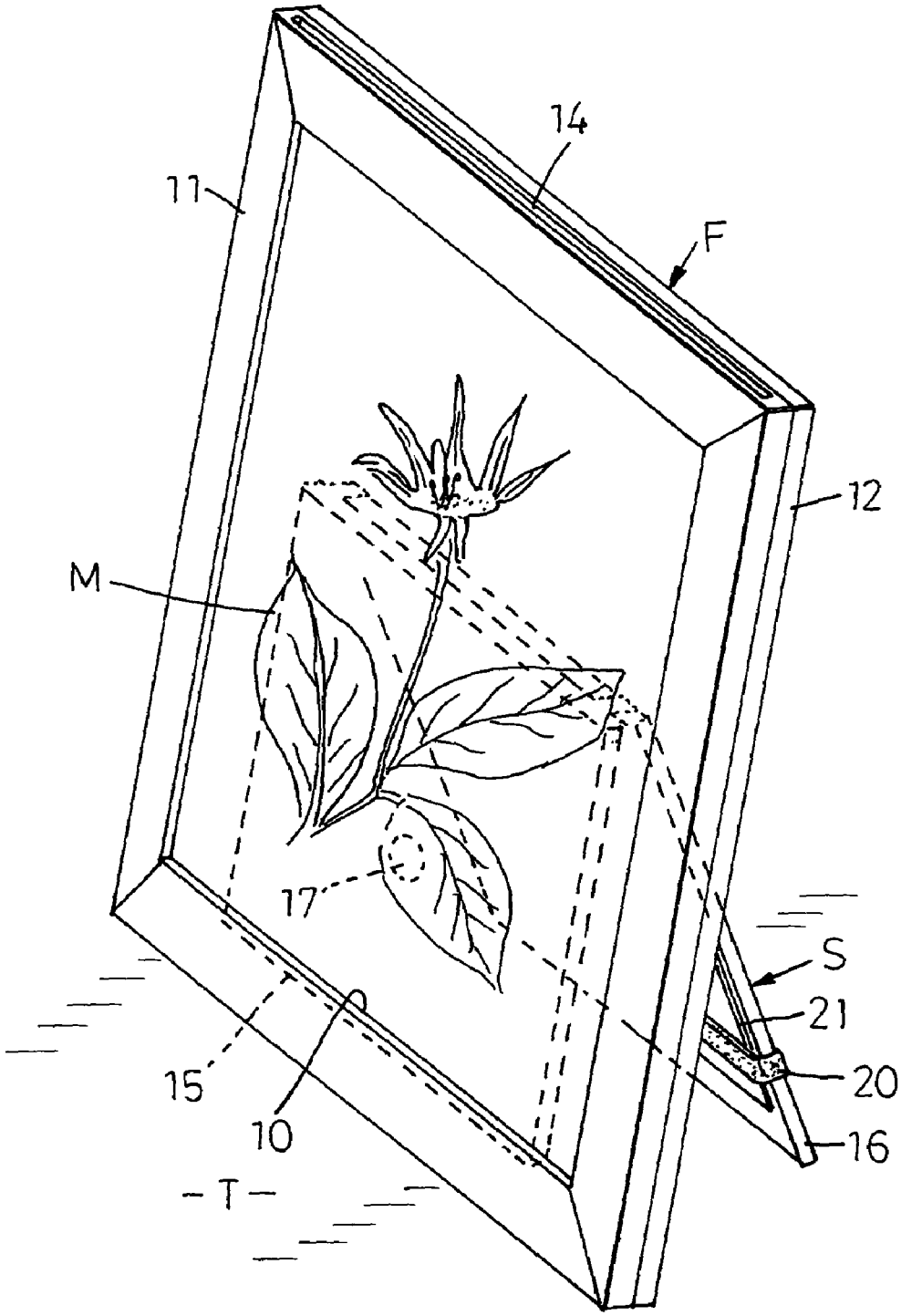
FIG. 7 is a perspective view showing a usage state that the frame is stood on a table surface so that a shorter side is set at the top.
Figure 8:
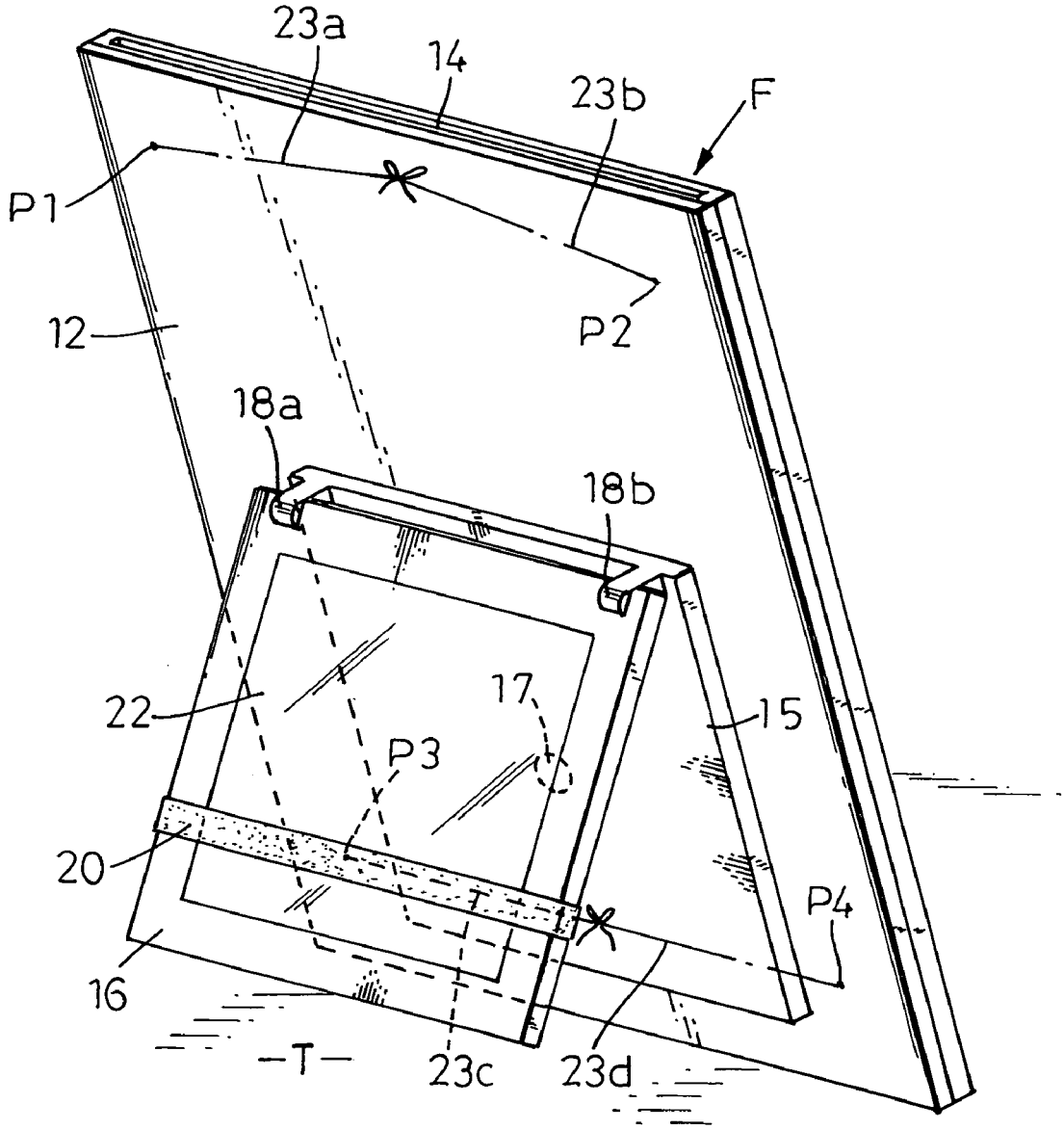
FIG. 8 is a perspective view of FIG. 7 observed from behind.
Figure 9:
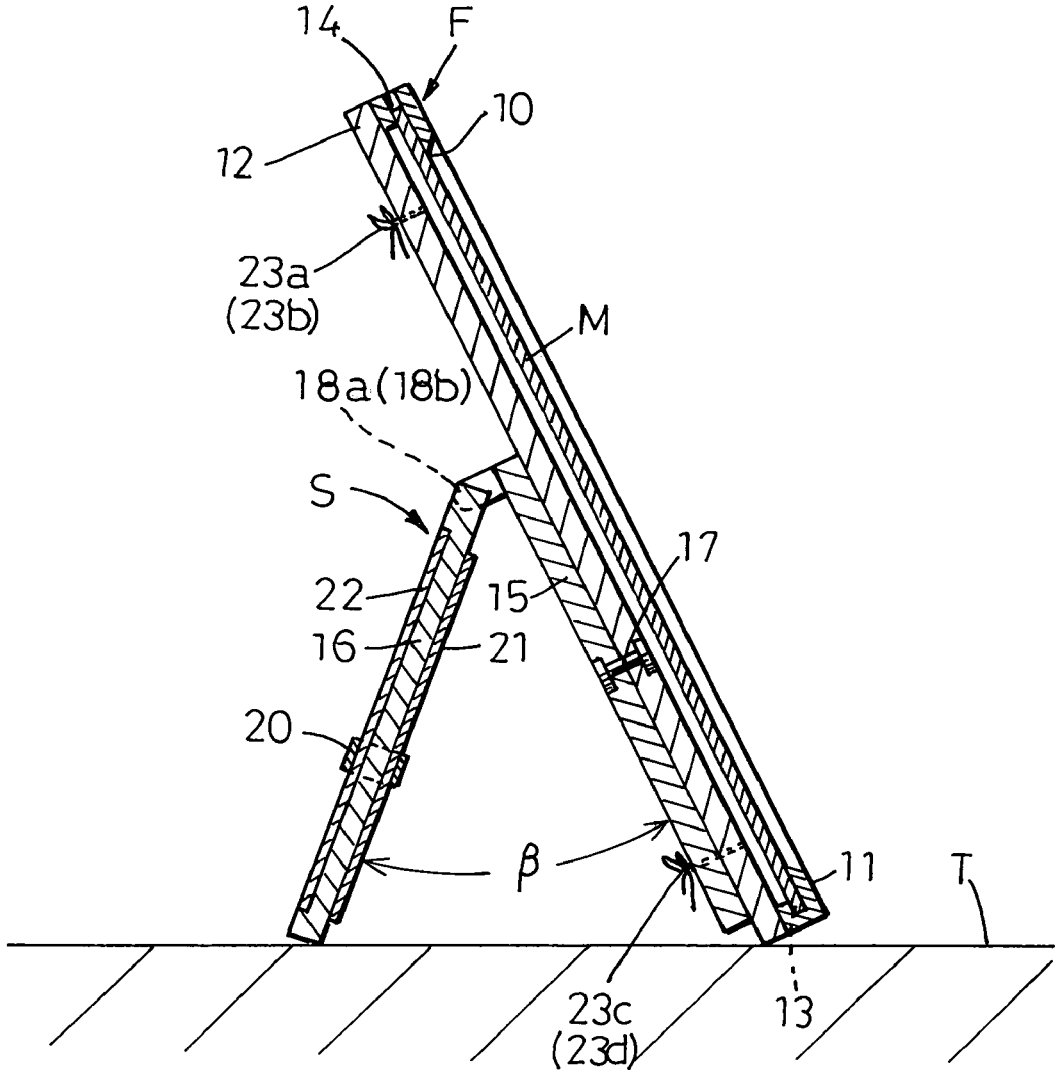
FIG. 9 is a longitudinal sectional view of FIG. 7.
Figure 13:
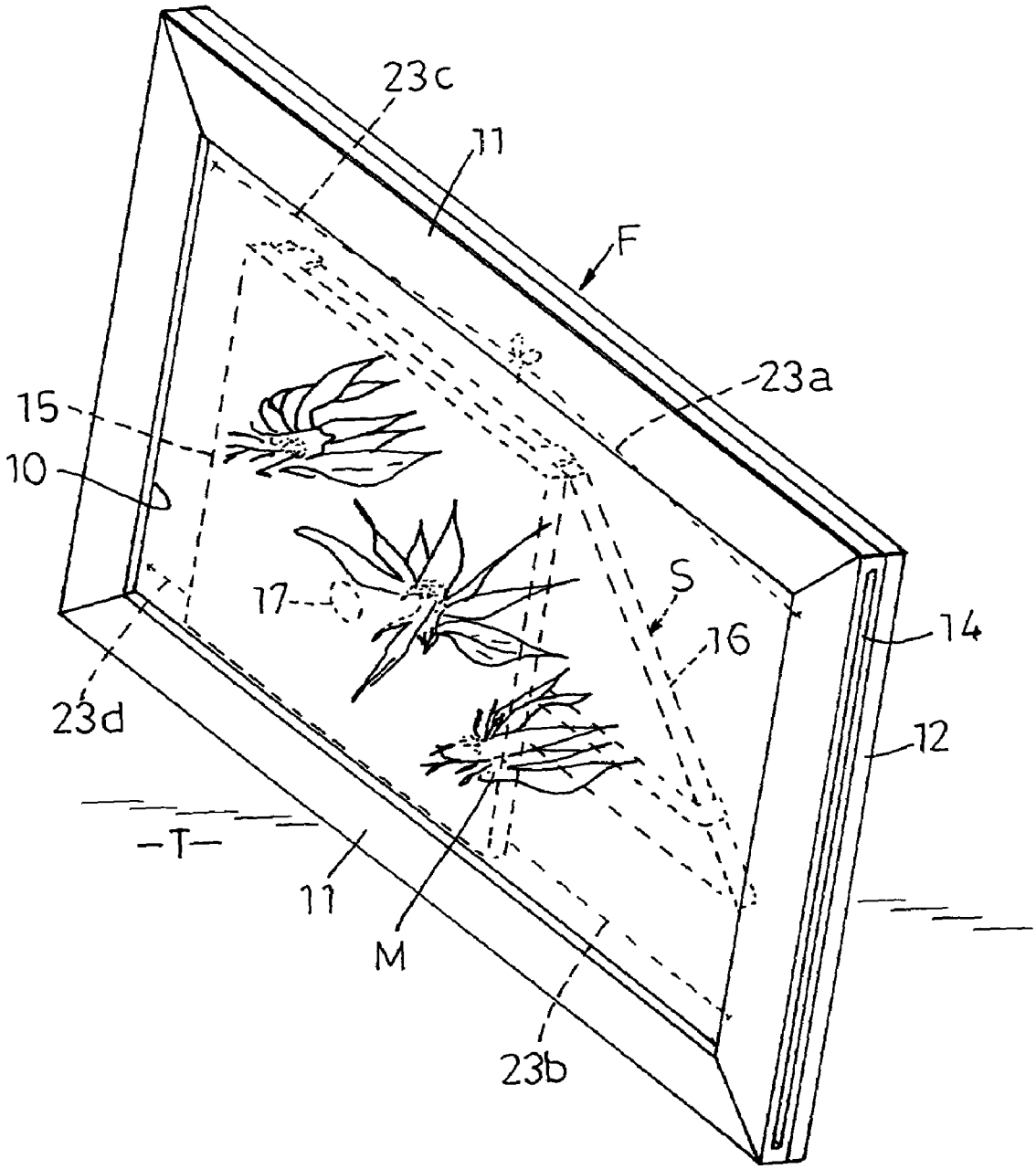
FIG. 13 is a perspective view showing a usage state that the frame is stood on a table surface so that a longer side is set at the top.
Figure 14:
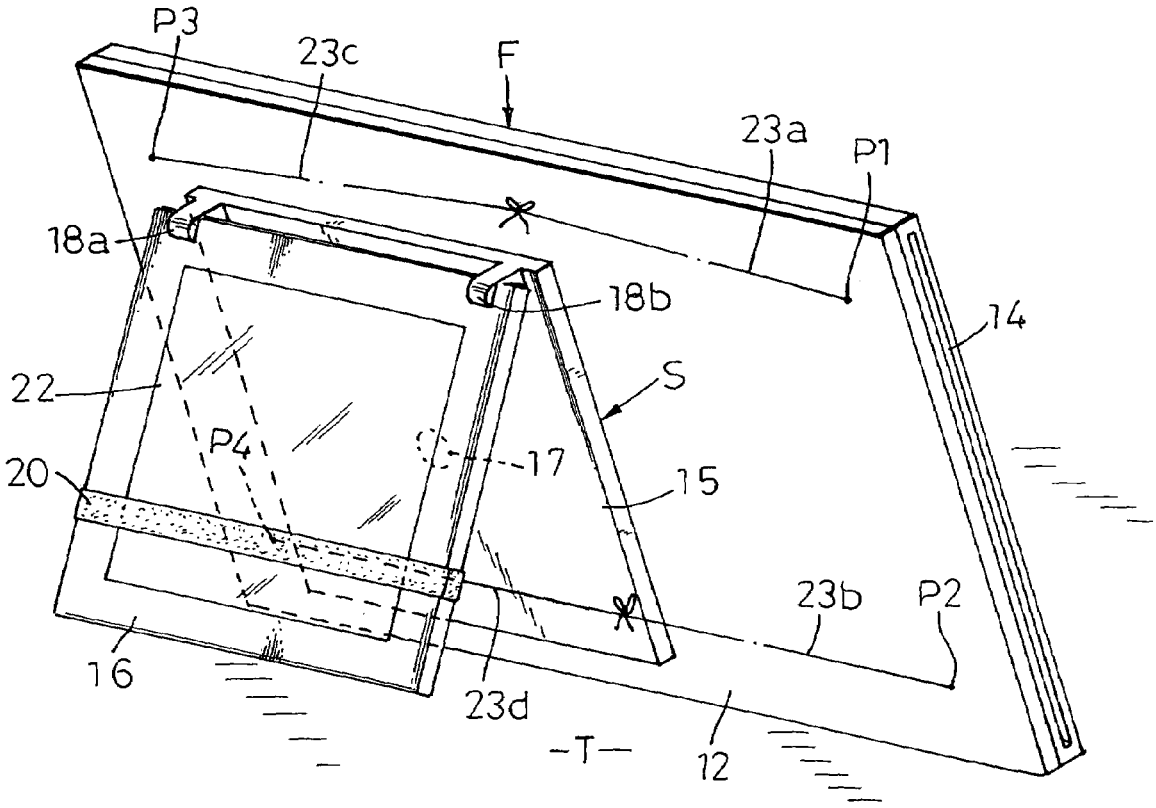
FIG. 14 is a perspective view of FIG. 13 observed from behind.
Figure 15:
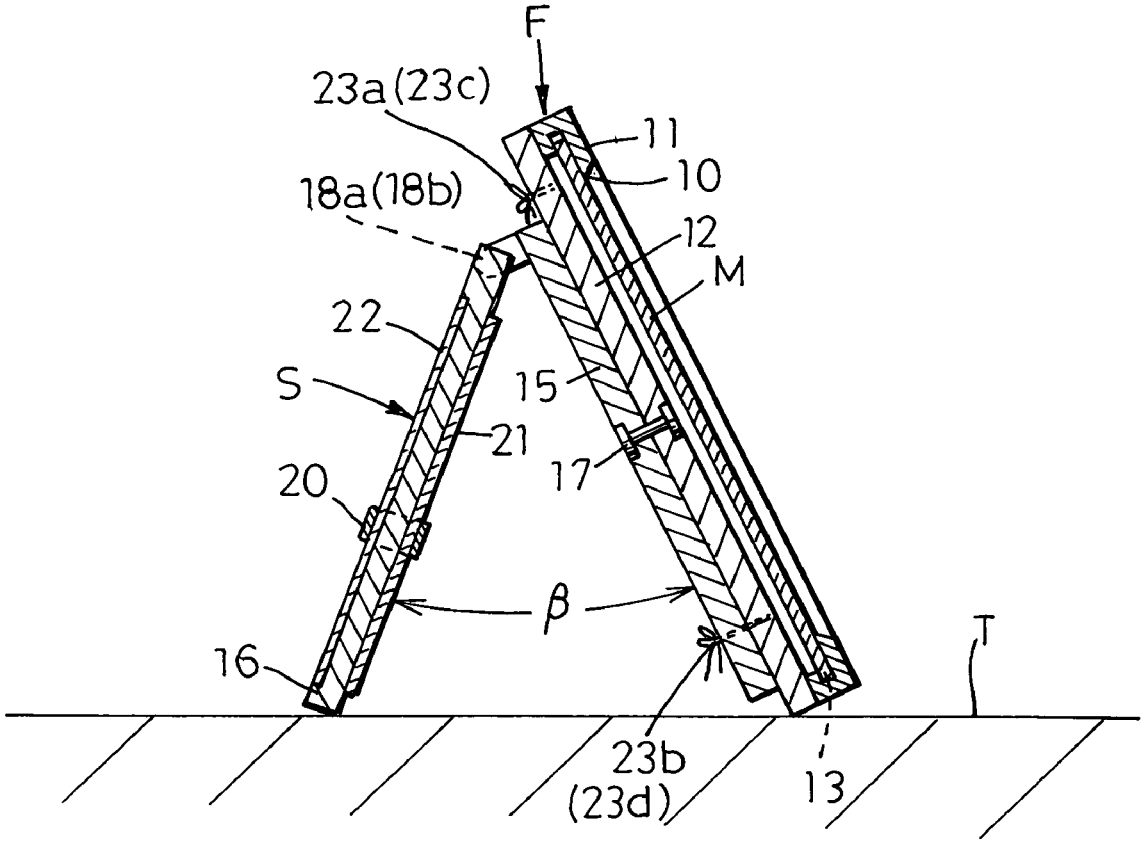
FIG. 15 is a longitudinal sectional view of FIG. 13.

Furthermore, the third and fourth cables (23*c*) and (23*d*) tied on the lower positions as shown in FIG. 2 and FIG. 3 and the second and fourth cables (23*b*) and (23*d*) tied on the lower positions as shown in FIG. 10 are respectively untied, and the ground seat (16) of the stand (S) which consequently becomes free to be opened and closed is pulled up to the rear side from the turning base plate (15) and opened by an appropriate crossover angle (b), whereby the frame main body (F) can be stably stood and used on the table surface (T) in a state that a shorter side is at the top as shown in FIG. 7 through FIG. 9 or a longer side is at the top as shown in FIG. 13 through FIG. 15.

In this case, as seen in FIG. 8 and FIG. 9 or FIG. 14 and FIG. 15, the two third and fourth cables (23*c*) and (23*d*) or the two second and fourth cables (23*b*) and (23*d*) whose tied states have been released are tied across the turning base plate (15) of the stand (S) or the back plate (12) of the frame main body (F) so that they are prevented from dangling and being ungracefully exposed.

The two first and second cables (23*a*) and (23*b*) or the two first and third cables (23*a*) and (23*c*) remaining on the upper positions may be left tied.

In the first embodiment of the present invention described based on FIG. 1 through FIG. 15, because of the comparatively great difference in length between the longer side (y) and the shorter side (x) of the frame main body (F), the turning base plate (15) and the ground seat (16) of the stand (S) are formed into rectangular shapes with the same size and are pivotally joined in a half folded state from the opening and closing hinges (18*a*) and (18*b*), and the central portion of the turning base plate (15) is pivotally supported on an eccentric position close to the shorter side (x) of the back plate (12) of the frame main body (F) by one turning fulcrum shaft (17), however, as apparent from FIG. 16 through FIG. 20 showing a second embodiment of the present invention, when the difference in length between the longer side (y) and the shorter side (x) of the frame main body (F) is comparatively small, the eccentric portion of the turning base plate (15) of the stand (S) may be pivotally supported on the central portion of the back plate (12) of the frame main body (F) by one turning fulcrum shaft (17).

As described above, it is also possible that the turning base plate (15) of the stand (S) is formed so that its contour shape becomes a semicircle smaller than the ground seat (16) (see FIG. 16), a square, or other shapes.

Figure 16:
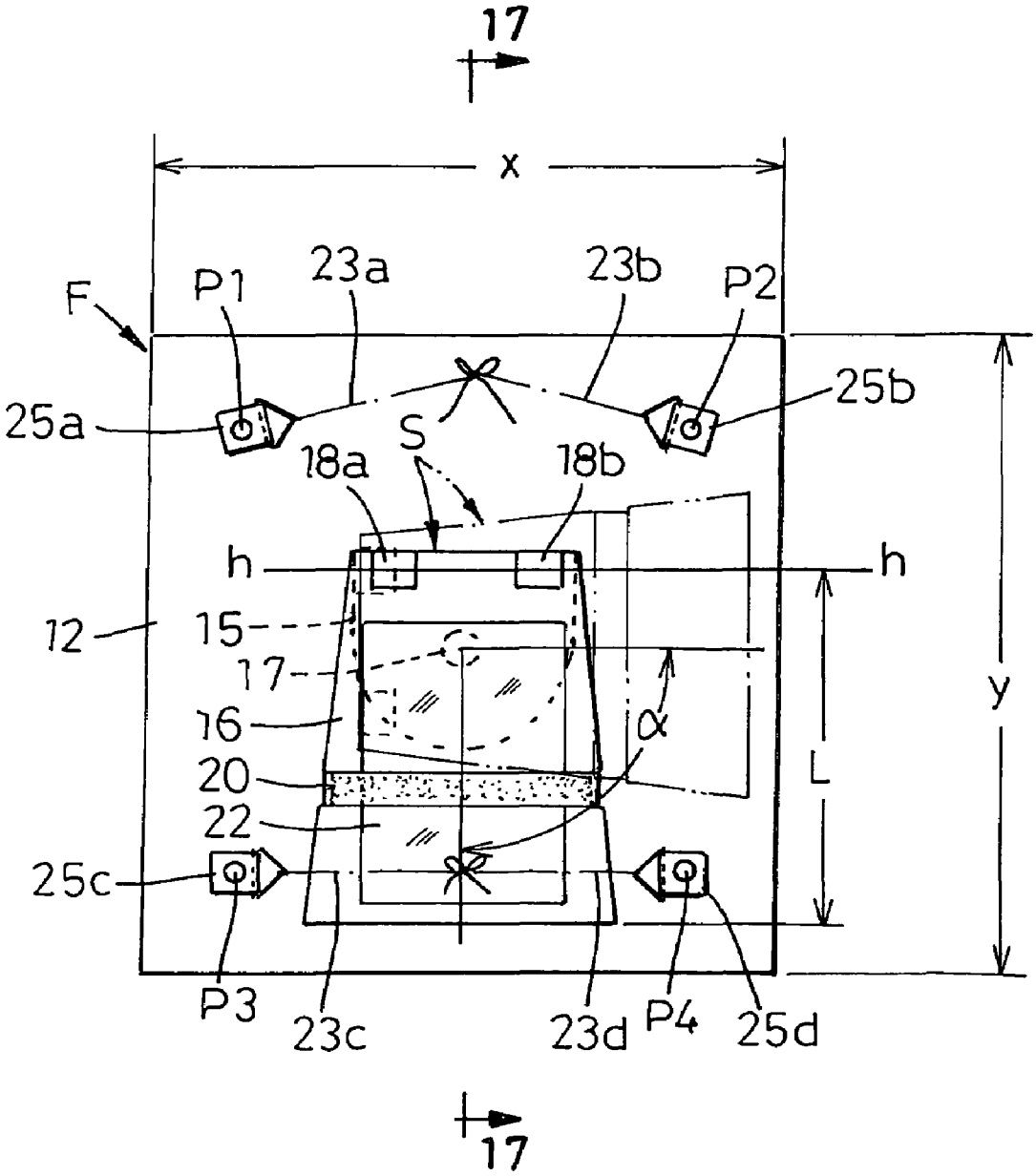
FIG. 16 is a back view showing a second embodiment of a frame with a stand according to the present invention.
Figure 17:
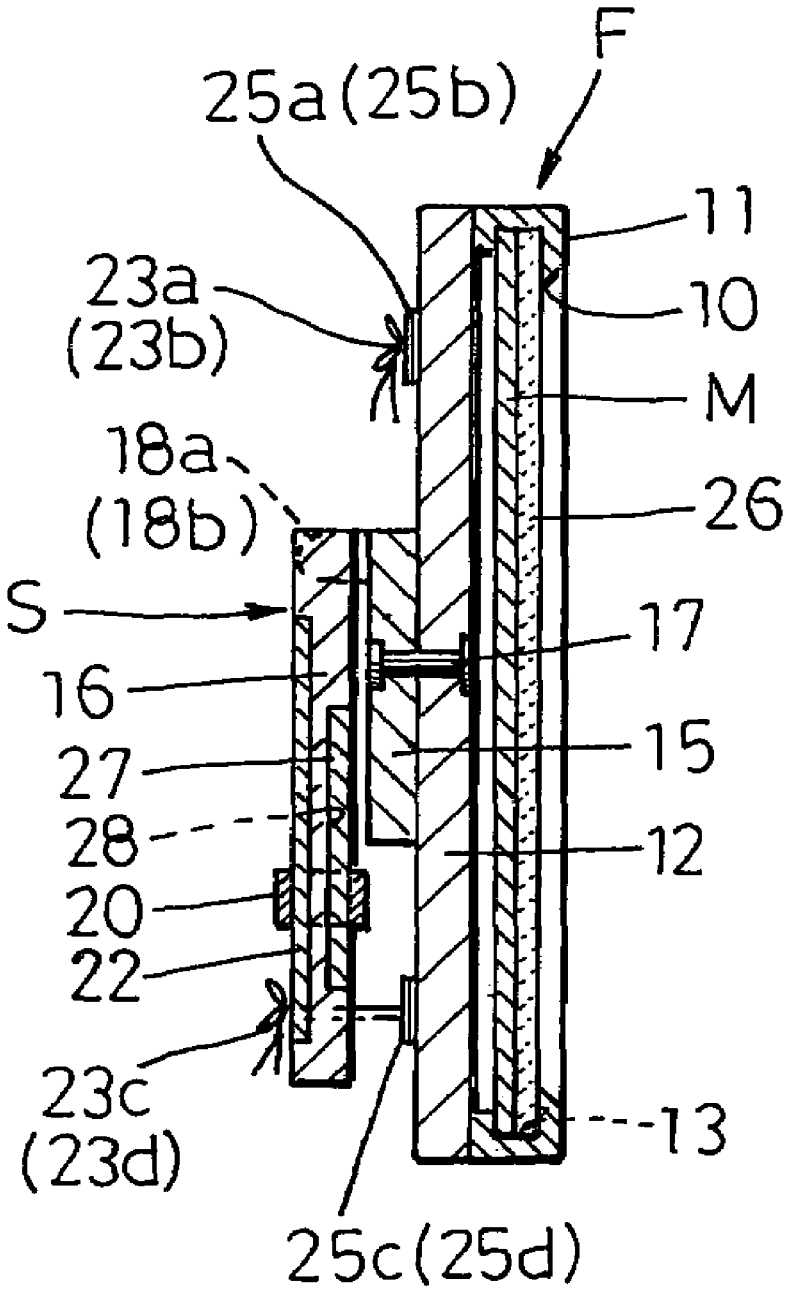
FIG. 17 is a sectional view along the 17-17 line of FIG. 16.
Figure 18:
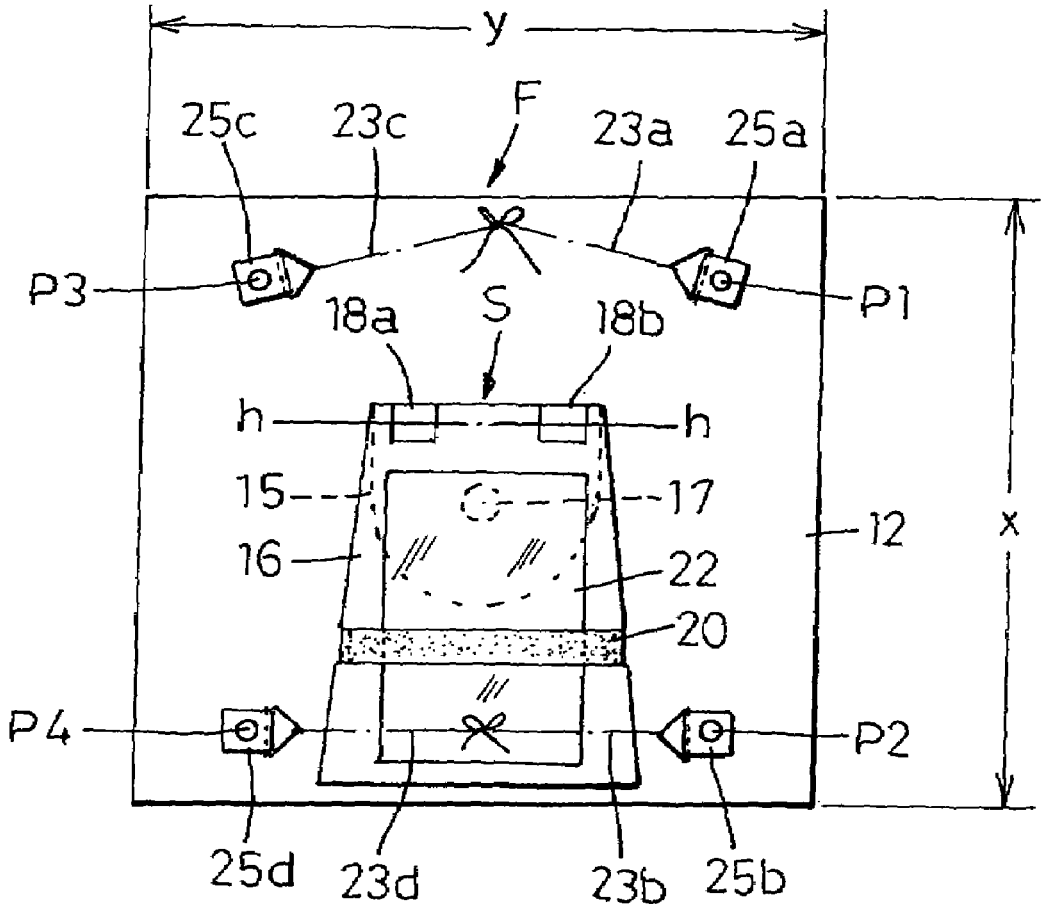
FIG. 18 is a back view in a state that the frame main body and the stand thereof are changed in orientation by approximately 90 degrees, respectively, from the state of FIG. 16.
Figure 19:
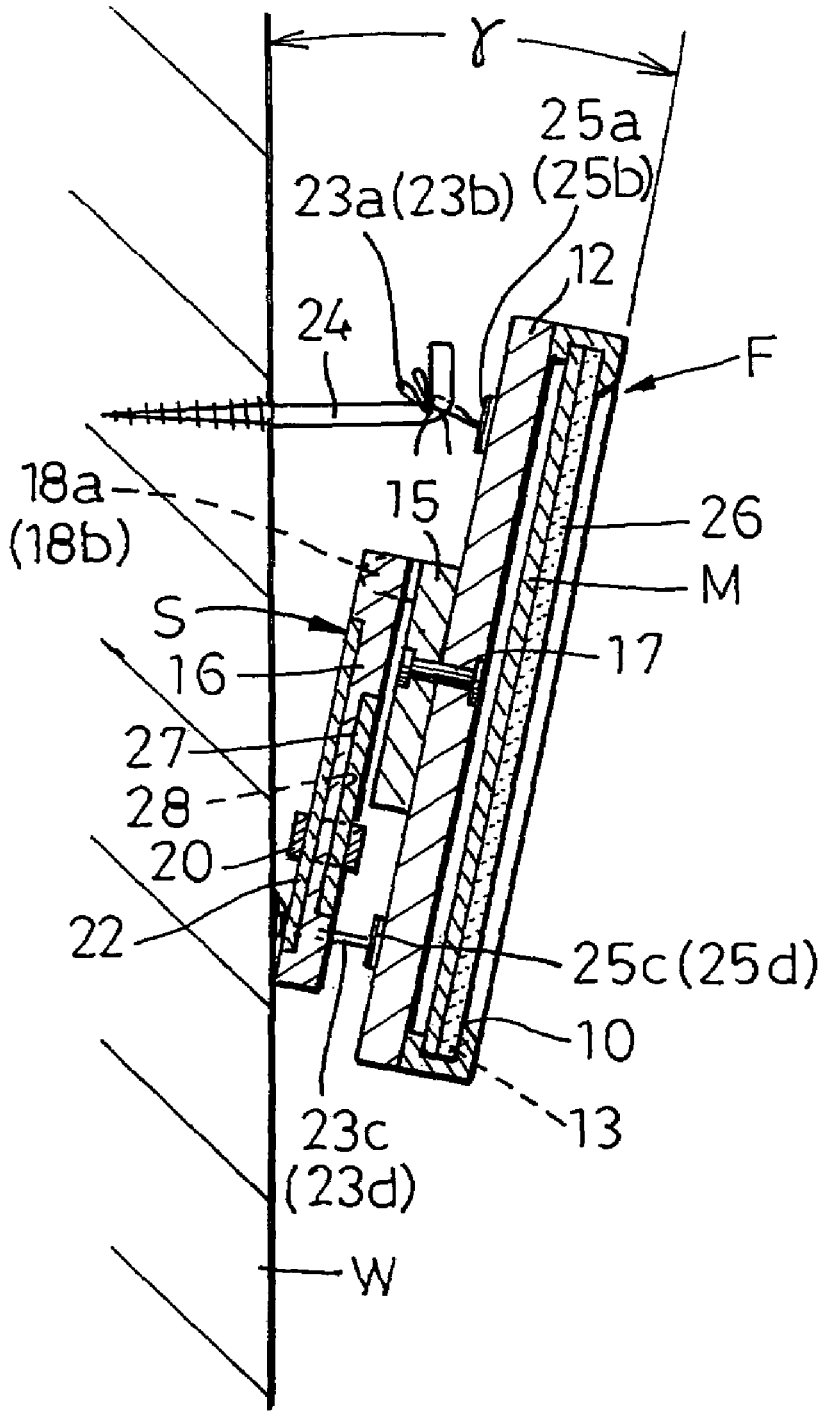
FIG. 19 is a sectional view of a usage state that the frame of FIG. 16 is hung on a wall face of a building.
Figure 20:
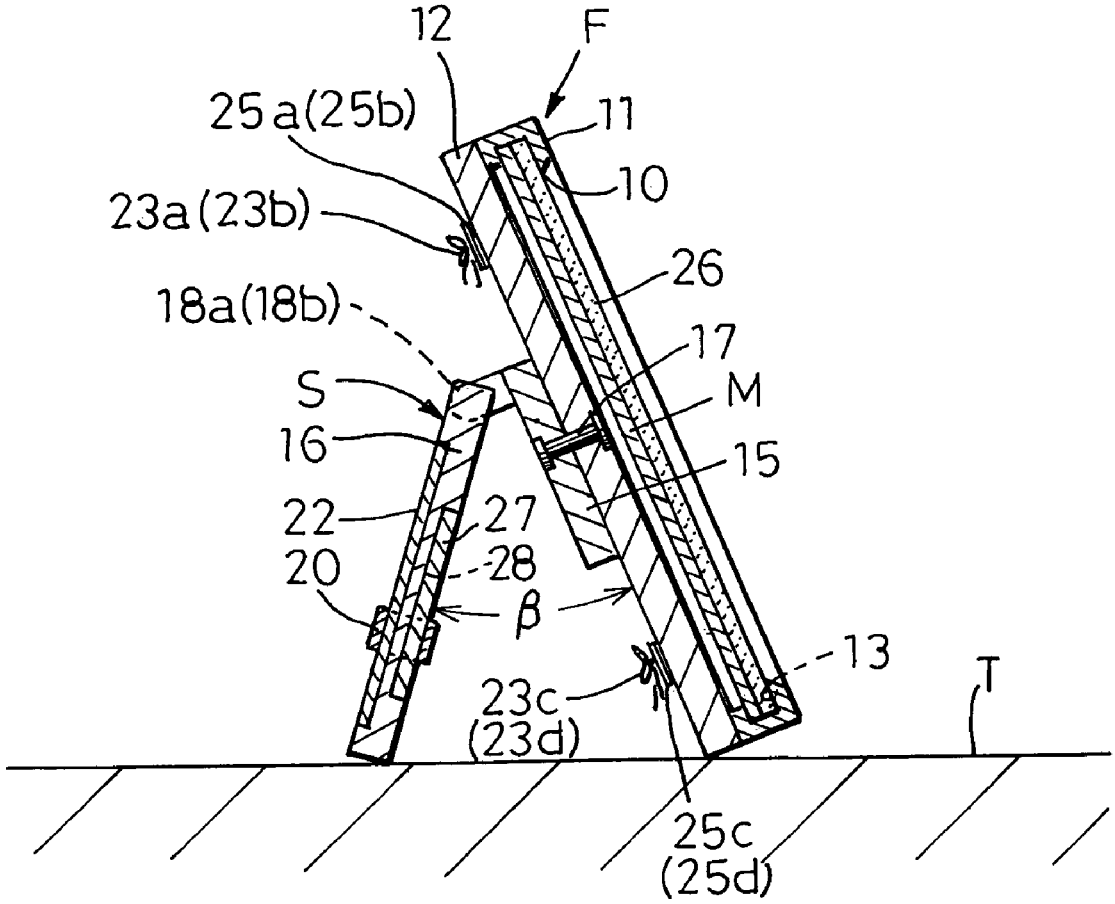
FIG. 20 is a sectional view of a usage state that the frame of FIG. 16 is stood on a table surface.

Even when employing this construction of the second embodiment, there is no risk that the ground seat (16) of the stand (S) whose orientation is changed by approximately 90 degrees (a) around the turning fulcrum shaft (17) of the turning base plate (15) to become long lengthwise and sideways as shown by the chain line of FIG. 16 projects and is exposed from the four sides of the frame main body (F) in a state that the ground seat (16) is closed and folded down to the turning base plate (15), and the ground seat is thus hidden behind the frame main body (F).

In the first embodiment of the present invention, the four in total of first through fourth cables (23*a*), (23*b*), (23*c*), and (23*d*) are integrally attached to the vicinities of the four corners (P1), (P2), (P3), and (P4) of the back plate (12) of the frame main body (F) so as not to come off, however, instead of this construction, as in the second embodiment shown in FIG. 16 through FIG. 20, it is also possible that another first through four hanging rings (25*a*), (25*b*), (25*c*), and (25*d*) are pivotally supported so as to become rotatable individually in the vicinities of the four corners (P1), (P2), (P3), and (P4) of the back plate (12) from behind, the first through fourth cables (23*a*), (23*b*), (23*c*), and (23*d*) are inserted through or tied to the respective hanging rings (25*a*), (25*b*), (25*c*), and (25*d*) in advance, and each one cable can be replaced with a new one by removing it from the hanging ring (25*a*), (25*b*), (25*c*), or (25*d*).

Similarly, in the case of the first embodiment shown in FIG. 1 through FIG. 15, the exhibit sheets (M) housed in the exhibit sheet housing space (13) of the frame main body (F) are barely exposed from the see-through window (10) opened in the decorative frame (11), however, instead of this construction, as shown in the second embodiment of FIG. 16 through FIG. 20, it is also possible that a dustproof cover (26) formed of a transparent synthetic resin plate, synthetic resin film, or thin glass plate is integrally affixed on the inner surface of the decorative frame (11) of the frame main body (F) in a backing state, and the see-through window (10) may be shielded in a manner that the exhibit sheets (M) can be seen through, and this maintains the exhibit sheets (M) in a dustproof state.

In the first embodiment described above, a decorative mirror (22) that is convenient for daily life is integrally buried in the outer surface of the ground seat (16) of the folding stand (S), however, as additionally shown in the second embodiment of FIG. 16 through FIG. 20, instead of or in addition to the installation of the decorative mirror (22), a housing concave groove (28) for housing various cards (27) such as synthetic resin-made prepaid cards, credit cards, health consultation tickets which have the same shape and size may be notched in the outer surface of the ground seat (16) or the inner surface of the ground seat (16) facing the turning base plate (15).

Thereby, similar to various storing sheets (21) with indeterminate forms, the various cards (27) housed inside the housing concave groove (28) can also be pressed against the ground seat (16) by the stretching band (20) used for the ground seat (16) of the stand (S) so as not to fall, and therefore this is useful for preventing the cards (27) from being lost.

Figure 21:
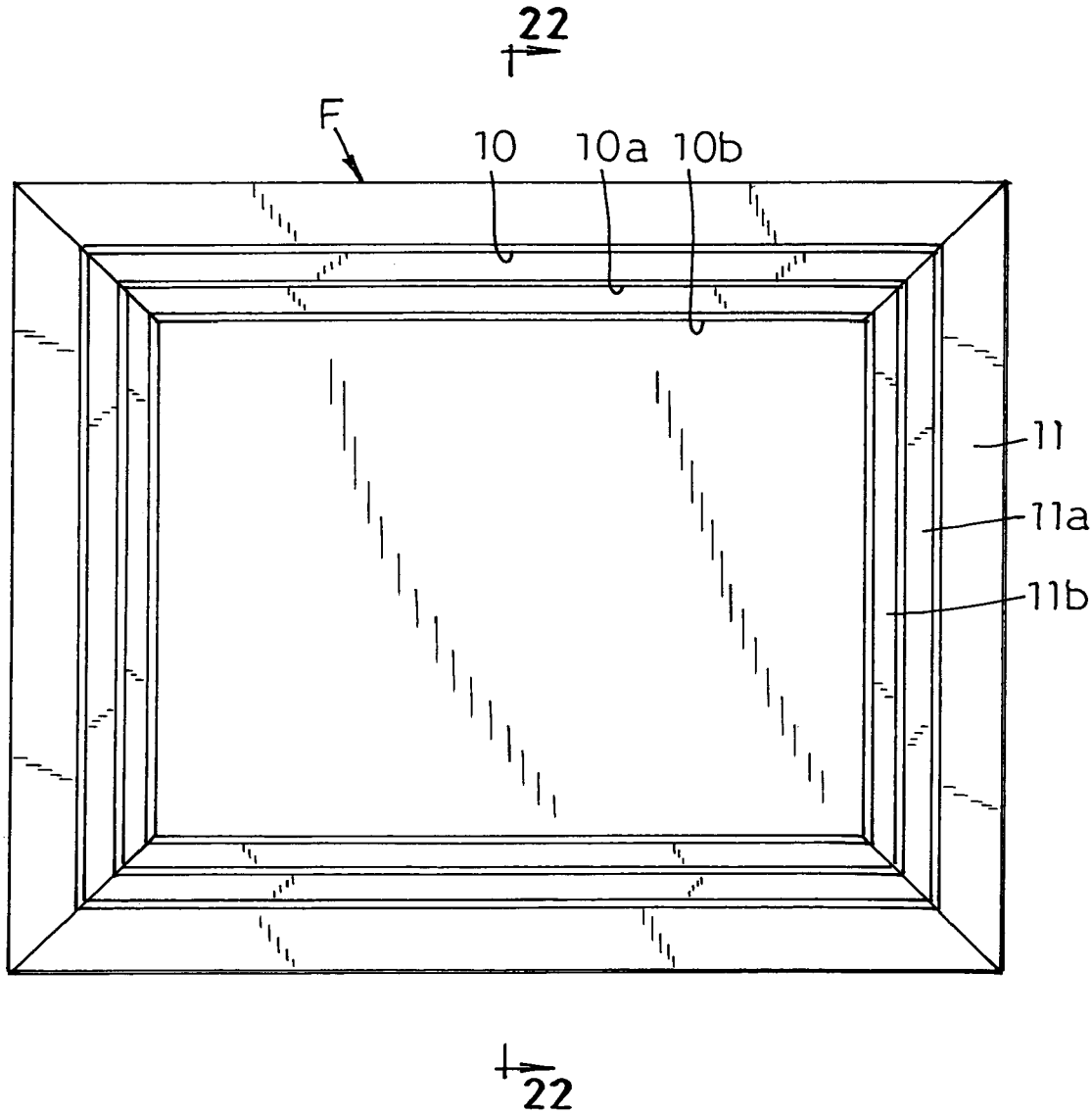
FIG. 21 is a front view showing a third embodiment of a frame with a stand according to the present invention.
Figure 22:
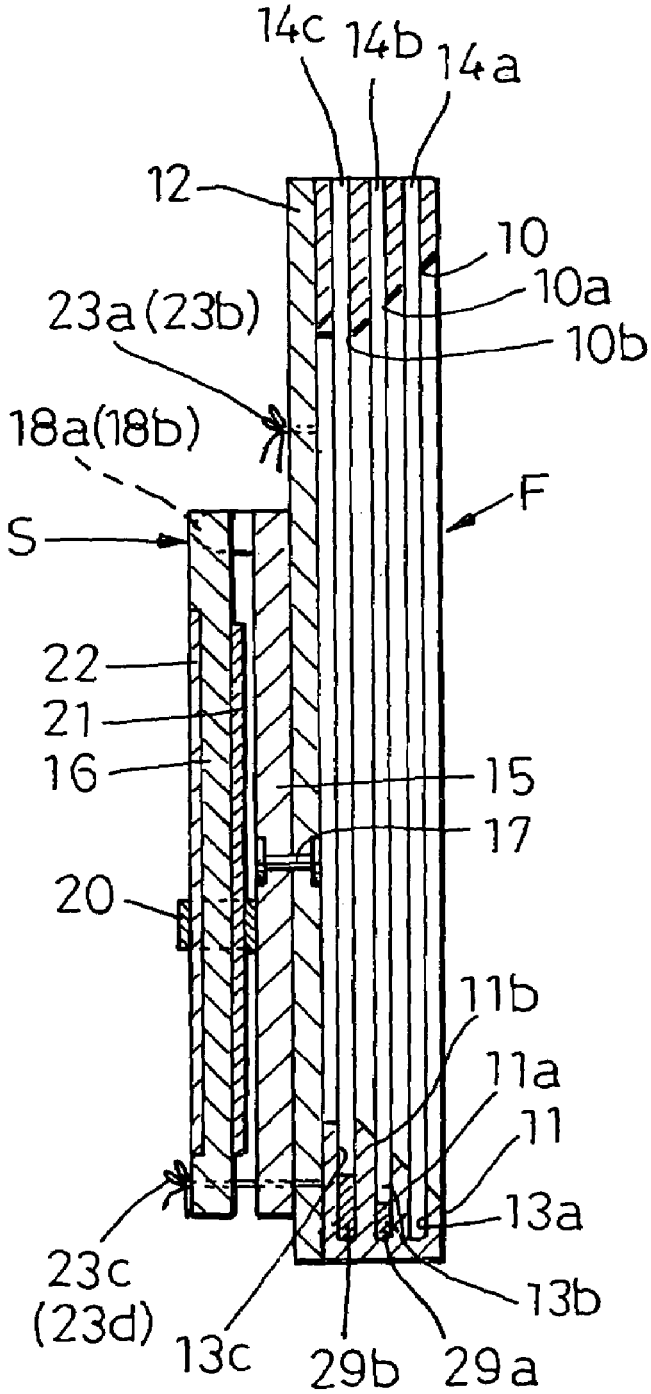
FIG. 22 is a sectional view along the 22-22 line of FIG. 21.
Figure 23:
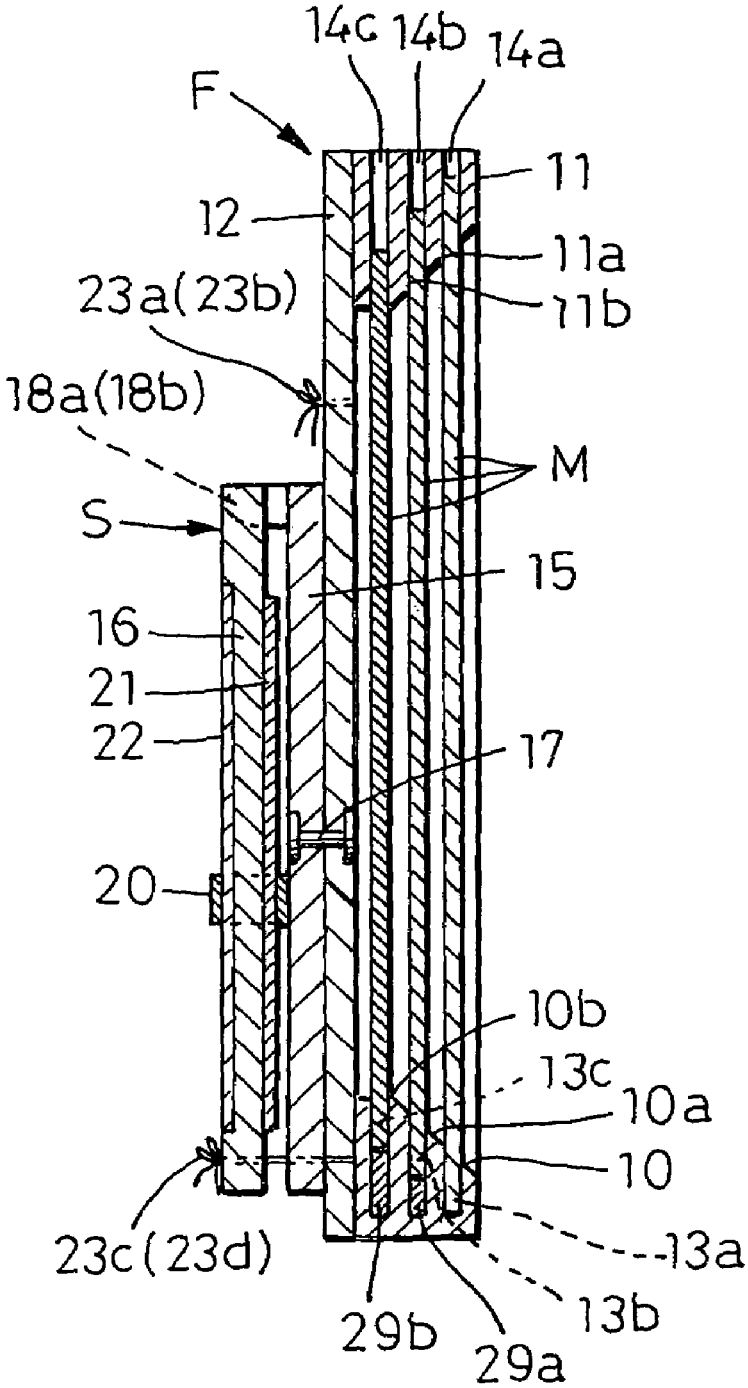
FIG. 23 is a sectional view in a state that exhibit sheets with different sizes are housed in the frame of FIG. 22.

Furthermore, in the first and second embodiments of the present invention shown in FIG. 1 through FIG. 20, the space between the decorative frame (11) and the back plate (12) of the frame main body (F) in the front and rear direction is demarcated as one exhibit sheet housing space (13), however, as apparent from FIG. 21 through FIG. 23 showing a third embodiment of the present invention, it is also possible that a plurality (three in the illustrated embodiment) of exhibit sheet housing spaces (13*a*), (13*b*), and (13*c*) including at least a pair of front and rear spaces arranged in line may be demarcated by inserting and fixing at least one (two in the illustrated embodiment) partition decorative frame (11*a*) and (11*b*) between the decorative frame (11) and the back plate (12) in the front and rear direction.

Furthermore, in this case, see-through windows (10*a*) and (10*b*) with similar entire shapes which are smaller than the see-through window (10) and become gradually smaller toward the rear side (inner side) from the position of the see-through window (10) opened in the forefront decorative frame (11) are opened in the central portions of the respective partition decorative frames (11*a*) and (11*b*) so as to a maintain a state that the exhibit sheets (M) housed in the respective exhibit sheet housing spaces (13*a*), (13*b*), and (13*c*) can always be visually observed from the front side of the frame main body (F).

It is obvious that a corresponding plurality (three in the illustrated embodiment) of exhibit sheet in/out slits (14*a*), (14*b*), and (14*c*) which communicate with the respective exhibit sheet housing spaces (13*a*), (13*b*), and (13*c*) are also opened in one side which becomes the upper side position when the frame main body (F) is used or two adjacent longer side (y) and shorter side (x) in the same manner as in the first embodiment described above.

Then, in order to naturally maintain the exhibit sheets (M) housed in the respective exhibit sheet housing spaces (13*a*), (13*b*), and (13*c*) in the positional relationship in which they are centered with the see-through windows (10), (10*a*), and (10*b*) with different sizes, centering packings (29*a*) and (29*b*) are integrally fitted to the insides of the respective exhibit sheet housing spaces (13*a*), (13*b*), and (13*c*) so as to face the exhibit sheet in/out slits (14*a*), (14*b*), and (14*c*).

By employing this construction of the third embodiment, even when the exhibit sheets (M) such as pictures and photos have a difference in size, these can be selectively housed in the exhibit sheet housing spaces (13*a*), (13*b*), and (13*c*) corresponding to the sizes with convenience, and an excellent decoration effect in which a margin does not appear can always be obtained.

Other constructions, operating methods, and usage states according to the second and third embodiments of the present invention are substantially the same as those in the first embodiment, so that the reference symbols corresponding to those in FIG. 1 through FIG. 15 are only entered in FIG. 16 through FIG. 23, and detailed description thereof is omitted.

What is claimed is:

1. A frame with a stand comprising:

a frame main body having a rectangular contour shape which houses various exhibit sheets such as pictures and photos in a manner enabling them to be put in and taken out of a space in the front and rear direction between a decorative frame having a see-through window and a back plate integrally fixed to the back side of the decorative frame in an edging state so that the exhibit sheets are seen through the see-through window;

a folding stand formed into a size hidden behind the frame main body by a turning base plate pivotally attached to the back plate of the frame main body via one turning fulcrum shaft so that the turning base plate is changeable in orientation by at least approximately 90 degrees to become long lengthwise and sideways and a ground seat pivotally joined to the turning base plate via opening and closing hinges positioned on a straight line parallel to one side of the frame main body so as to be operated to open from and close to the turning base plate; and four in total of first through fourth cables attached to the vicinities of the four corners of the back plate of the frame main body so as not to come off in a positional relationship corresponding to intervals to sandwich the stand, wherein each two cables of the first through fourth cables are selectively tied between a state that the cables extend parallel to each other along a shorter side of the frame main body and a state that the cables extend parallel to each other along a longer side of the frame main body, by the two cables tied on the lower positions, the ground seat of the stand is locked in a closed state that the ground seat is folded down to the turning base plate, and the other two tied cables on the upper positions are hung on a hook projecting from a wall face of a building, whereby the frame main body can be hung and used in a state that a shorter or longer side is at the top, and the two cables on the lower positions tied to lock the ground seat are released and the ground seat is pulled up and opened from the turning base plate, whereby the frame main body can be stood and used on a table surface in a state that a shorter or longer side is at the top.

2. The frame with a stand according to claim 1, wherein the turning base plate and the ground seat of the folding stand are formed into rectangular shapes with the same size and pivotally joined together in a half-folded state via opening and closing hinges positioned on a straight line parallel to one side of the frame main body, and a central portion of the turning base plate is pivotally attached to an eccentric position close to the shorter side of the back plate of the frame main body by one turning fulcrum shaft.

3. The frame with a stand according to claim 1, wherein the space in the front and rear direction between the decorative frame and the back plate of the frame main body is demarcated as one exhibit sheet housing space, and a transparent dustproof cover which can shield the see-through window is integrally affixed to the inner surface of the decorative frame in a backing state, and an exhibit sheet in/out slit which communicates with the exhibit sheet housing space is opened only in one side that becomes the upper side position when the frame main body is used or adjacent two sides of a longer side and a shorter side.

4. The frame with a stand according to claim 1, wherein the space in the front and rear direction between the decorative frame and the back plate of the frame main body is demarcated as exhibit sheet housing spaces including at least a pair of front and rear spaces arranged in line by at least one partition decorative frame interposed inside, exhibit sheet in/out slits which communicate with the respective exhibit sheet housing spaces are opened on one side that becomes an upper side position when the frame main body or two adjacent sides of a longer side and a shorter side, and see-through windows which are similar in shape to each other and gradually become smaller toward the rear side position from the position of the see-through window of the forefront decorative frame on the forefront position are opened in the respective partition decorative frames.

5. The frame with a stand according to claim 1, wherein the ground seat of the folding stand is formed into a rectangular shape, a square, or an isosceles trapezoid and a decorative mirror is integrally buried in the outer surface of the ground seat, a housing concave groove for housing various cards whose shapes and sizes are fixed are notched in an inner surface of the ground seat facing the turning base plate, and a stretching band which can hold the various cards housed in the housing concave groove is wound around the ground seat in a manner the band can be unwound.

* * * * *